US006068416A

United States Patent [19]

Kumamoto et al.

[11] Patent Number: 6,068,416

[45] Date of Patent: May 30, 2000

[54] KEYBOARD SWITCH

[75] Inventors: Kiyomi Kumamoto, Isesaki; Seigo Hasunuma, Nitta-gun; Seiki Katakami, Isesaki, all of Japan

[73] Assignee: Hosiden Corporation, Osaka, Japan

[21] Appl. No.: 09/228,399

[22] Filed: Jan. 12, 1999

[30] Foreign Application Priority Data

| | | | |
|---|---|---|---|
| Jan. 19, 1998 | [JP] | Japan | 10-007613 |
| Feb. 6, 1998 | [JP] | Japan | 10-025916 |
| Apr. 8, 1998 | [JP] | Japan | 10-096109 |
| Apr. 15, 1998 | [JP] | Japan | 10-105108 |
| May 22, 1998 | [JP] | Japan | 10-141020 |

[51] Int. Cl.[7] ..... B41J 5/08

[52] U.S. Cl. ..... 400/491; 400/495; 200/344

[58] Field of Search ..... 400/490, 491, 400/491.2, 495, 495.1, 496; 200/5 A, 341, 344, 345; 361/680

[56] References Cited

U.S. PATENT DOCUMENTS

| | | | |
|---|---|---|---|
| 5,504,283 | 4/1996 | Kako et al. | 200/5 A |
| 5,512,719 | 4/1996 | Okada et al. | 200/344 |
| 5,793,605 | 8/1998 | Sellers | 361/680 |
| 5,813,778 | 9/1998 | Shih | 400/496 |
| 5,823,325 | 10/1998 | Lin | 200/344 |
| 5,901,837 | 5/1999 | Aimi | 200/344 |
| 5,947,616 | 9/1999 | Liang | 400/491.2 |
| 5,967,298 | 10/1999 | Watanabe et al. | 200/344 |

*Primary Examiner*—Ren Yan

*Attorney, Agent, or Firm*—Pollock,Vande Sande & Amernick

[57] ABSTRACT

A pattern sheet, an insulation sheet and a frame made of sheet metal are successively built up on a plate made of sheet metal, a pair of links pivotally connected together intermediate their opposite ends to form a pantograph mechanism are movably engaged at their one ends with respective bearings formed on the frame by a drawing process while the other ends of the links are movably engaged with respective bearings formed on the bottom surface of a key top.

14 Claims, 22 Drawing Sheets

KEYBOARD SWITCH

BACKGROUND OF THE INVENTION

This invention relates to a keyboard switch suitable for use with various kinds of equipment such as personal computers, word processors, etc., and particularly to a keyboard switch having key tops configured to be supported by means of pantograph mechanisms.

FIG. 1 illustrates an example of the prior art keyboard switch having such configuration wherein on a plate 1 constituting a keyboard substrate is disposed a membrane sheet 2 on which a housing 3 is carried.

As shown in details in FIG. 2, the membrane sheet 2 comprises a pair of laminated contact layers 2A and 2B spaced apart by a predetermined distance by a spacer 2C, and a contact pattern 2D and contact patterns 2E, 2F formed on the opposed surfaces of the contact layers, the contact pattern 2D and contact patterns 2E, 2F together comprising contacts. It is to be understood that upon pressure being applied to the contact layer 2A from above at the contact region, the contact pattern 2D and contact patterns 2E, 2F will be brought into contact with each other to establish electrically conductive continuity between the contacts 2E and 2F through the contact 2D to thereby provide a contact signal.

The housing 3 made of resin material has an opening 4 formed therethrough in opposition to the contact region to expose that surface of the membrane sheet 2 covering the contact region and its vicinity, and a dome-like rubber member 5 is disposed on the membrane sheet 2 within the region of the opening 4. The dome-like rubber member 5 comprises a vertically flexible skirt portion 5A and a push-button portion 5B connected with the top of the skirt portion 5A.

A pair of links 6 and 7 forming a pantograph mechanism is constructed as shown in FIGS. 3A and 3B. The link 6 comprises a pair of parallel link members which are interconnected at their intermediate portions by a central pressure-applying portion 6A for pressing on the rubber member 5. The parallel link members have stud shaft holes 6B formed on the opposite sides of the pressure-applying portion 6A for receiving respective stud shafts 7A extending inwardly from the opposed sides of a pair of link arms forming the other link 7. It is thus to be understood that the two links 6 and 7 are assembled together in an X-shaped form at their middle portions for relative pivotal movement by engaging the stud shafts 7A of the link 7 with the stud shaft holes 6B of the link 6.

More specifically, the first link 6 has a pair of stud shafts 6C extending inwardly toward each other from first ends of the link members. The link members are interconnected at their second ends by a cross-bar extending therebetween and terminating at its opposite outer ends in outwardly projecting stud shafts 6D. The second link 7 has a pair of stud shafts 7C extending oppositely outwardly from first ends of the link members. The link members of the second link are interconnected at their second ends by a cross-shaft 7B extending therebetween.

The stud shafts 7C are rotatably supported in corresponding journal bearings 17A formed in the bottom side of the key top 17 while the stud shafts 6D are rotatably supported in corresponding journal bearings 3A formed in the housing 3. On the other hand, the stud shafts 6C are slidably supported in corresponding slide bearings 17B formed in the bottom side of the key top 17 while the stud shafts 7B are slidably supported in corresponding slide bearings 3B formed in the housing 3. In this manner, the pressure-applying portion 6A of the link 6 is located in opposing contact with the top surface of the push-button portion 5B of the rubber member 5 whereby the links 6 and 7 are held in their erected position by the resilient restoring force of the rubber member 5, that is, the key top 17 is held in its top dead center.

Downward pressing operation on the key top 17 will move the links 6 and 7 comprising the pantograph mechanism toward the face of the housing 3 as the key top 17 moves parallel to the face of the housing 3. During this process, the pressure-applying portion 6A of the link 6 presses on and collapses the rubber member 5 downward to provide good tact feeling while at the same time the contact region of the membrane sheet 2 is pressed on by the push-button portion 5B whereby the ON-OFF operation of the contacts is effected.

It should be noted here that with an advance in downsizing and portability of equipment provided with the keyboard switch of the type discussed herein, there is an increasing demand for a keyboard switch both lighter in weight and lower in profile. Particularly, there is a need for a keyboard switch retaining the length of key stroke substantially equal to that of the conventional keyboard switch while having a further decreased thickness.

Nevertheless, in the prior art keyboard switch having the construction as described above, one of the factors for constructionally hindering reduction in thickness (vertical profile) is the thickness of the housing 3. Specifically, since the housing 3 is formed of resin, it is not permitted to make it too thin due to the moldability as well as from the point of view of the rigidity and thermal stability as a housing, resulting in the disadvantage of inhibiting the reduction in thickness.

SUMMARY OF THE INVENTION

In view of the problems as discussed above, an object of this invention is to provide a keyboard switch configured to allow for alteration in construction and reduction in thickness of the housing.

The keyboard switch according to this invention comprises a pattern sheet having contact patterns formed on one side surface thereof; an insulation sheet disposed on said pattern sheet and formed with an aperture to expose said contact patterns; a frame formed of metal sheet disposed on said insulation sheet, said frame having an opening formed therethrough in an area opposing said aperture and the periphery of the aperture; a pair of links each engaged at its one end with respective bearings formed on the frame around said opening by a drawing process, the two links pivotally connected together intermediate their opposite ends to form a pantograph mechanism; a key top engaged with and supported by the other ends of the links for movement generally parallel to the plane of said frame, a dome-like rubber member disposed on said insulation sheet and having a conductor portion therein adapted to be brought into contact with said contact patterns when said key top is pressed down and then to allow the pressed down key top to return to its original position; and a plate formed of metal sheet disposed on the other side surface of said pattern sheet so as to sandwich the pattern sheet and the insulation sheet between the plate and said frame.

In the aforesaid keyboard switch, said pattern sheet and insulation sheet are formed with aligned apertures within which said frame and said plate may be welded together.

In an alternate embodiment, the keyboard switch may comprise a plate made of sheet metal; a membrane sheet disposed on said plate; a frame formed of sheet metal disposed on the membrane sheet and having an opening formed therethrough in an area opposing the contact portion formed on the membrane sheet; a pair of links each engaged at its one end with bearings formed on the frame around said opening by a drawing process, the two links pivotally connected together intermediate their opposite ends to form a pantograph mechanism; a key top engaged with and supported by the other ends of the links for movement generally parallel to the plane of said frame; and a dome-like rubber member disposed on the membrane sheet and having a push-button portion adapted to press on the contact portion as said key top is pressed down and then to allow the pressed down key top to return to its original position.

DETAILED DESCRIPTION OF THE PREFERRED EMBODIMENTS

The various embodiments of this invention will be described with reference to the accompanying drawings.

First embodiment

Figure 4:
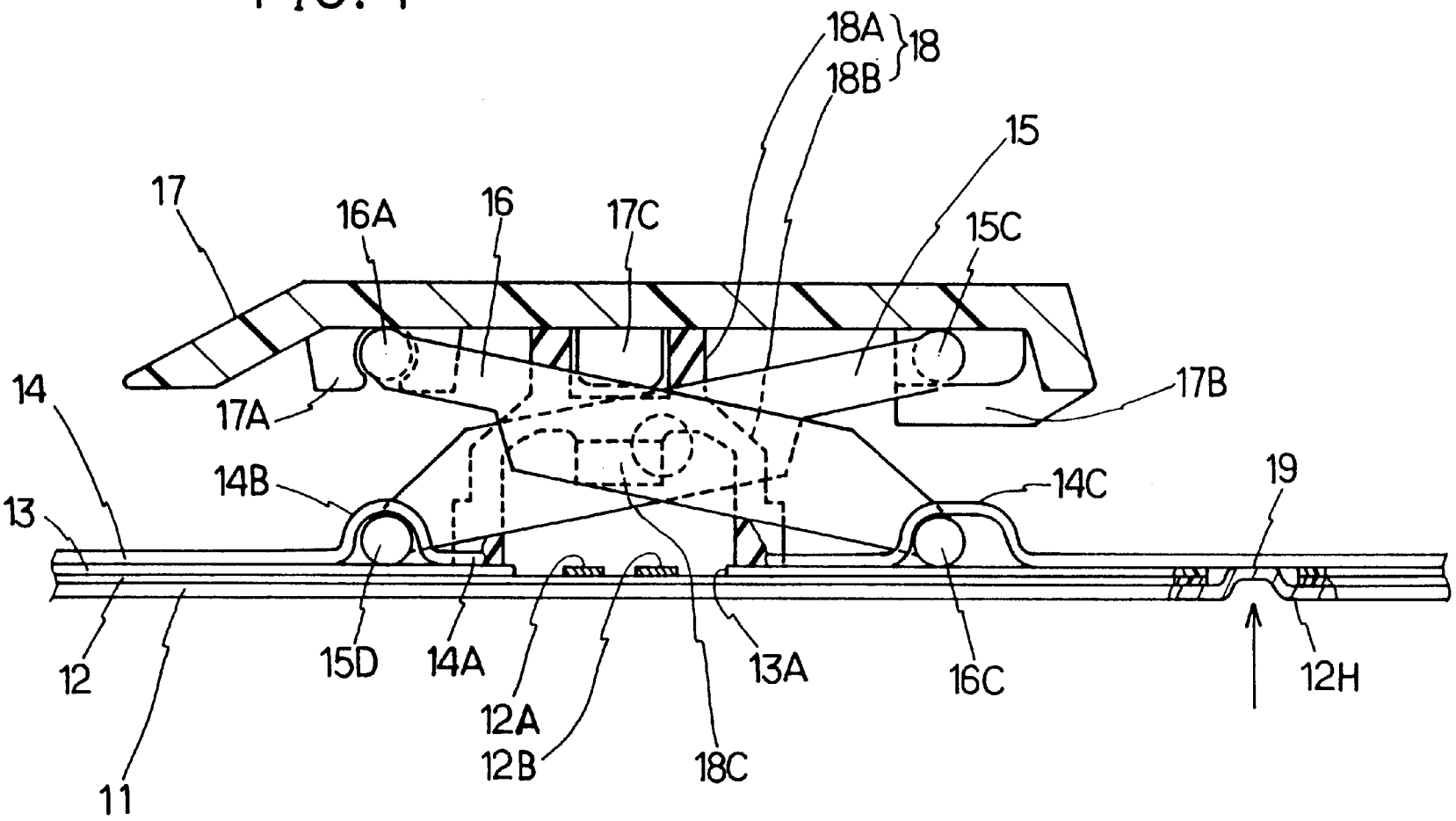
FIG. 4 is a cross-sectional view illustrating a first embodiment of this invention.

FIG. 4 illustrates a first embodiment of this invention. In this embodiment, on a plate 11 made of sheet metal is disposed a pattern sheet 12 on which a frame 14 is disposed with an electrical insulation sheet 13 sandwiched between the sheet 12 and the frame 14. The pattern sheet 12 has contact patterns 12A, 12B formed on one side surface thereof and the insulation sheet 13 is formed with an aperture 13A to expose the contact patterns 12A, 12B.

Figure 5A:
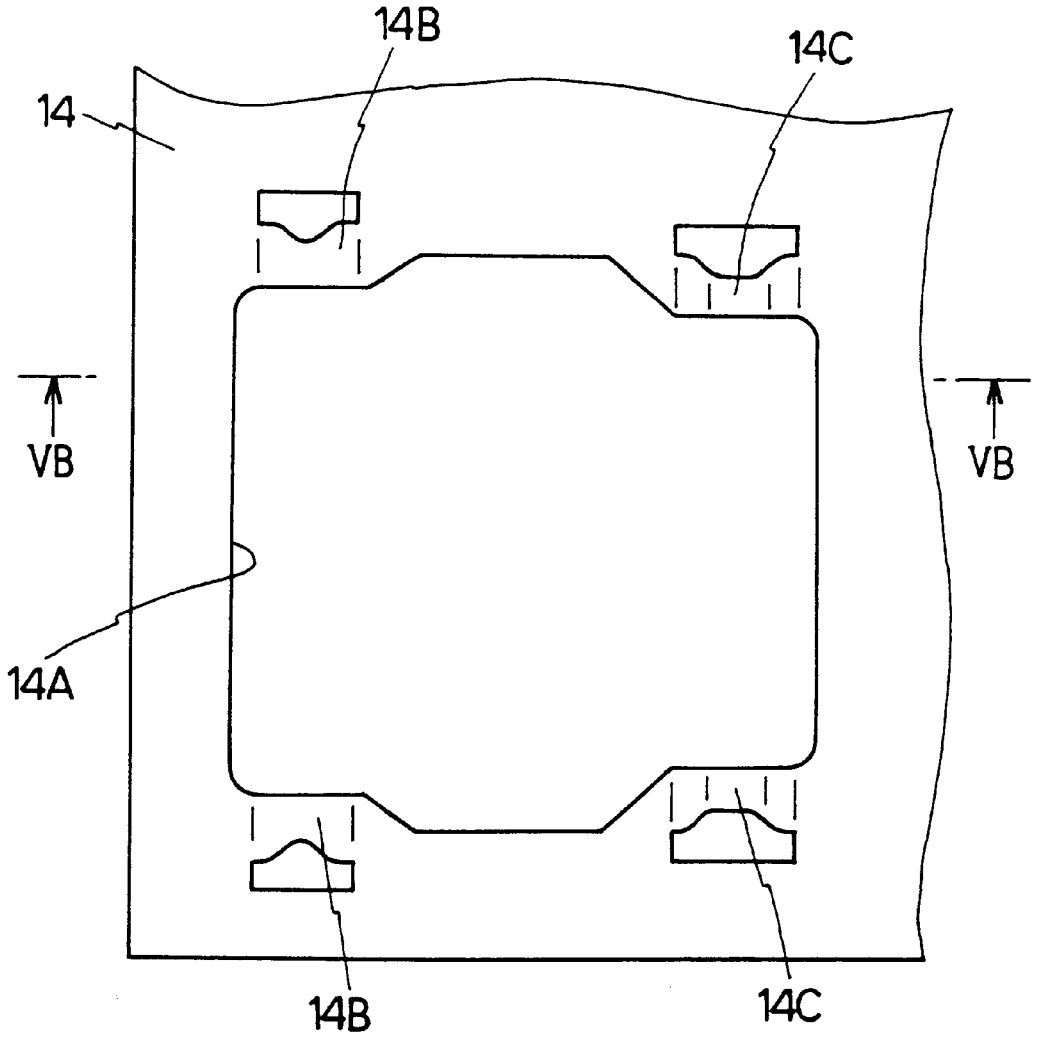
FIG. 5A is a plan view of the frame shown in FIG. 4.
Figure 5B:
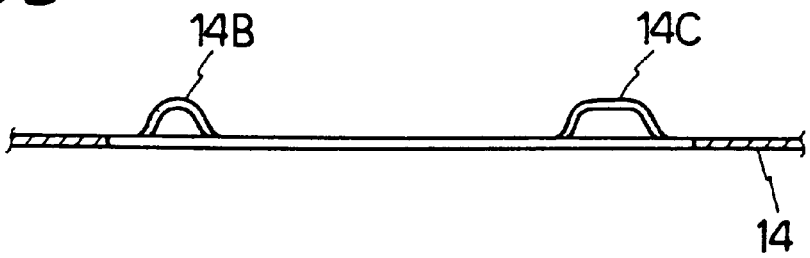
FIG. 5B is a cross-sectional view of the frame taken on line VB—VB in FIG. 4.

The frame 14 has formed therethrough an opening 14A aligned with and surrounding the periphery of the aperture 13A. The opening 14A is of generally square shape in this example as shown in FIG. 5A. The frame 14 further has formed thereon a pair of opposed journal bearings 14B and a pair of opposed slide bearings 14C adjacent the periphery of the opening 14A along two opposed sides thereof. As shown in FIG. 5B representing a cross-sectional view taken along the line VB—VB in FIG. 5A, the pair of oppositely positioned journal bearings 14B are formed convexly in a generally semi-circular shape on the frame 14 by a drawing process, and the other pair of oppositely positioned slide bearings 14C are likewise formed convexly in a generally trapezoidal shape on the frame 14 by a drawing process.

Figure 6B:
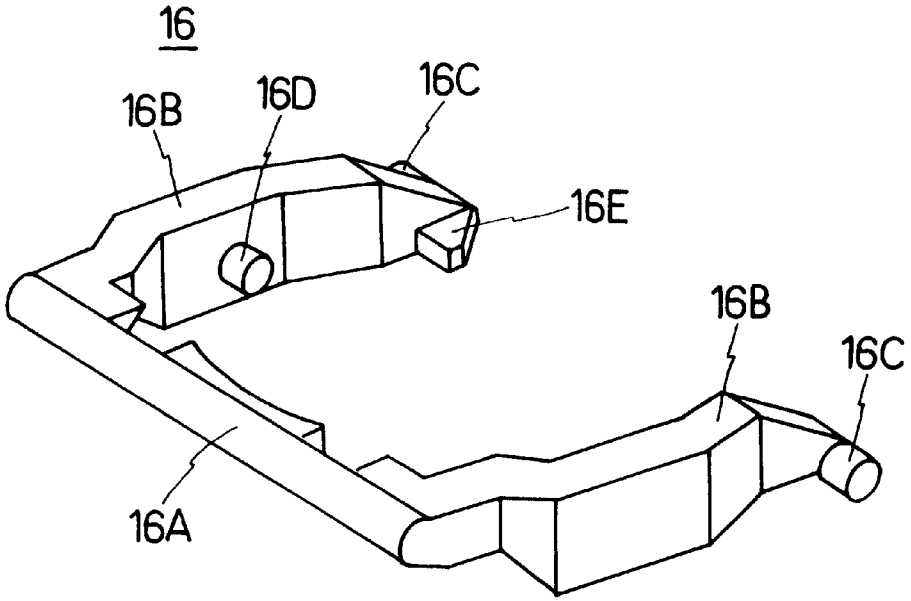
FIG. 6B is a perspective view of the link 16 shown in FIG. 4.
Figure 6A:
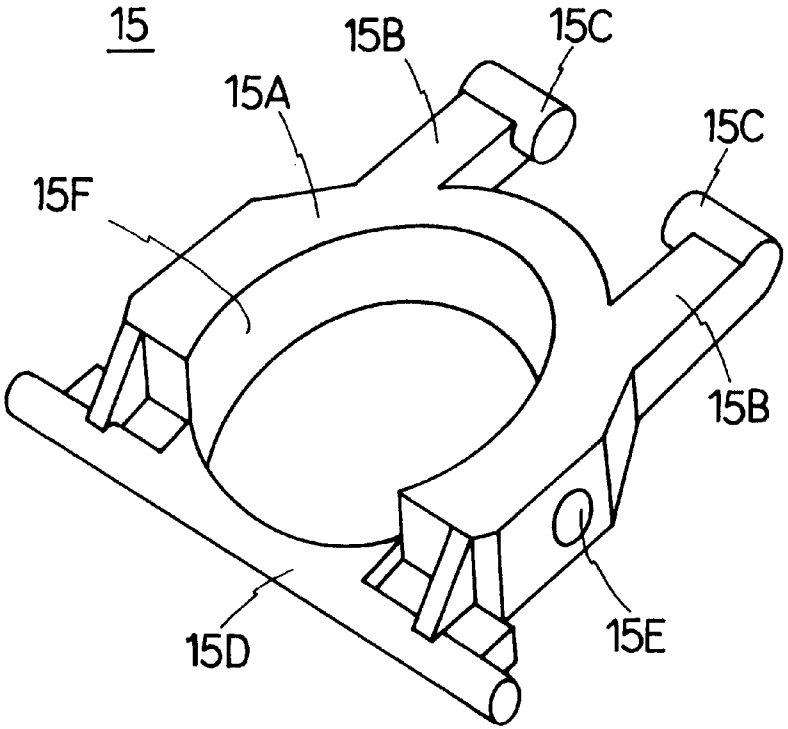
FIG. 6A is a perspective view of the link 15 shown in FIG. 4.

A pair of links 15, 16 which are to be engaged at their ends with the corresponding journal bearings 14B and slide bearings 14C to constitute a pantograph mechanism are constructed in this example as shown in FIGS. 6A and 6B. Specifically, the link 15 comprises a generally annular base portion 15A having a pair of spaced apart parallel legs 15B extending in the same direction from the outer periphery of the base portion along one semi-circular segment thereof The two legs 15B have stud shafts 15C extending inwardly toward each other and in linear alignment from the opposed sides thereof adjacent the outer ends, and a cross shaft 15D extending parallel to the stud shafts 15C and generally tangentially to the other semi-circular segment of the base portion 15A and terminating in opposite outer shaft ends outwardly projecting in linear alignment with each other. The side surfaces of the base portion 15A opposed in the diametrical direction parallel to the shaft 15D are flat surfaces in which shaft holes 15E are formed, respectively.

The other link 16 is generally of a U-shape comprising a cross shaft 16A and generally parallel legs 16B extending from the opposite ends of the shaft 16A. The legs 16B have stud shafts 16C extending outwardly oppositely therefrom adjacent the outer ends thereof and another pair of stud shafts 16D extending inwardly toward each other from the opposed inner sides thereof intermediate the inner and outer ends of the legs, the stud shafts 16D being adapted to be engaged in the corresponding shaft holes 15E of the link 15. It is noted that the links 15, 16 are made of resin.

It is thus to be appreciated that the two links 15 and 16 are assembled together in an X-shaped form at their middle portions for relative pivotal movement by engaging the pair of stud shafts 16D of the link 16 with the shaft holes 15E of the link 15. It should be noted here that the link 16 is provided on the inner sides of the legs 16B at their outer ends with stops 16E to limit the relative movement of the links 15 and 16 toward the overlapping relation.

The shaft 15D of the link 15 has its opposite shaft ends rotatably embraced in the corresponding journal bearings 14B of the frame 14 covered on their bottom sides by the insulation sheet 13 as shown in FIG. 4 while the pair of stud shafts 16C of the link 16 are slidably embraced in the corresponding slide bearings 14C of the frame 14 covered on their bottom sides by the insulation sheet 13. On the other hand, the cross shaft 16A of the link 16 is rotatably fitted in a pair of journal bearings 17A formed in the bottom side of the key top 17 while the pair of stud shafts 15C of the link 15 are slidably supported in corresponding slide bearings 17B formed in the bottom side of the key top 17.

A dome-like rubber member 18 is mounted on the electrical insulation sheet 13 and in this example extends through the central bore 15F of the base portion 15A and is interposed between the key top 17 and the insulation sheet 13. The rubber member 18 comprises a cylindrical portion 18A engageable with a projection 17C extending from the key top 17, and a dome portion 18B connecting with the cylindrical portion and terminating in a thickened lower end. It should be noted, however, that the projection 17C may be eliminated, in which case the rubber member 18 may be configured to include a columnar (solid cylindrical) portion in lieu of the hollow cylindrical portion 18A.

The dome portion 18B is located so as to surround the aperture 13A of the insulation sheet 13. Projecting from the ceiling of the dome portion 18B opposing the contact patterns 12A, 12B exposed in the aperture 13A is an electrical conductor which may be formed by printing or two-color molding (coinjection molding).

Upon being pressed downward by the operator, the key top 17 is moved generally parallel to the face of the frame 14 by virtue of the links 15 and 16 in the form of a pantograph mechanism. During this movement, the key top 17 presses on the rubber member 18 to deform and collapse the dome portion 18B, whereby good tact feeling is provided while at the same time the conductor 18C is brought into contact with the contact patterns 12A, 12B to establish continuity therebetween. Upon the downward pressure on the key top being released, the rubber member 18 returns to its original position by its resilient restoring force to cut off the continuity between the contact patterns 12A and 12B and to restore the key top to in its original position.

Securing the frame 14 and the plate 11 together to retain the pattern sheet 12 and the insulation sheet 13 therebetween is effected by laser welding in this example. In FIG. 4, the reference numeral 19 indicates the weld joint where a hole 12H is formed to extend through the pattern sheet 12 and the insulation sheet 13 such that the frame 14 and the plate 11 are facing each other and welded together through the hole 12H. The arrow in FIG. 4 indicates the direction of projection of laser beam.

Figure 1:
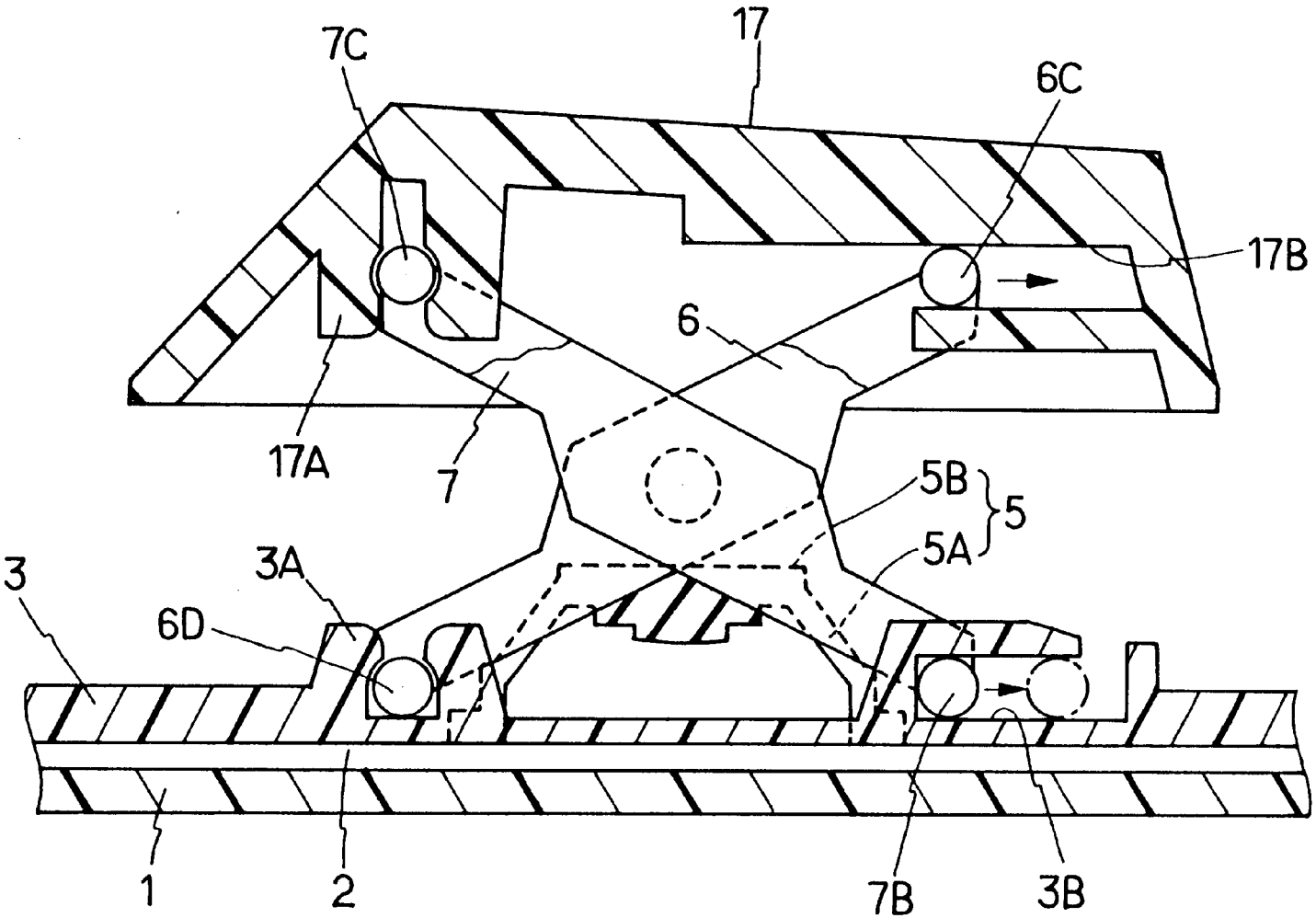
FIG.1 PRIOR ART
FIG. 1 is a cross-sectional view illustrating an example of the prior art keyboard switch.

In the construction as described above, the frame 14 made of metal sheet is employed in place of the housing 3 formed of resin as is the case with the prior art keyboard switch illustrated in FIG. 1 to thereby allow for a drastic reduction in thickness. By way of example, the housing 3 formed of resinous material required a thickness of at least about 0.9 mm from the viewpoint of its moldability and rigidity. In contrast, the metal frame 14 allows for a reduction in thickness to the order of 0.15 mm.

In addition, where a single sided pattern sheet such as the pattern sheet 12 is employed in lieu of the membrane sheet 2 in FIG. 1 as in the embodiment shown in FIG. 4, it is possible to aim at further reducing the thickness of the keyboard switch. It should also be noted that the bearings 14B, 14C of the metal frame 14 engageable with the links 15, 16 at their ends may be formed easily by a drawing process as noted above.

Further, it will be appreciated that since both the plate 11 and the frame 14 are constructed of sheet metal, that is, two metal sheets are used, an effective construction may be realized by selecting the materials individually. By way of example, when the frame 14 is made of stainless steel sheet and the plate 11 of aluminum sheet, the frame 14 provides a high rigidity while the plate 11 provides good heat radiation. In this case, it is also possible to reduce the thickness of the plate 11 as compared to that of the plate 1 of the prior art keyboard switch.

Following is a comparison in weight between the resinous housing 3 (which is generally formed of POM (polyoxymethylene) and the metal frame 14 assuming that the respective thicknesses are as noted above:

| | | |
|---|---|---|
| POM resin: | thickness 0.9 mm | specific gravity 1.5 |
| Stainless steel: | thickness 0.15 mm | specific gravity 7.8 |

This shows that the frame 14 formed of stainless steel is lighter than the resinous housing 3.

It should also be noted that the use of laser welding as indicated previously to bond the frame 14 and the plate 11 together offer the following effects:

(a) The bonding is effected in a non-contact manner so that no external forces are exerted on the parts to thereby avoid possible deformation and warping of the frame 14 and plate 11. In addition, the irradiation time of the laser beam is as short as about 1 msec. so that there will be no thermal influences on the surrounding environment.

(b) The bonding strength is as strong as 10 kg/one weld point, for example to allow for such a small nugget diameter as about A 0.7 mm, namely to enable a reduction in the bonding area, resulting in an advantage in enhancing the rigidity as well as downsizing the keyboard. It is also noted that there is no protrusion from the bottom surface of the plate 11.

(c) Automation of welding is facilitated, and high speed welding such as 5 to 10 weld points/sec., for example is enabled.

(d) Effecting the welding by a irradiating laser beam from the side of the plate 11 makes it possible to alleviate deterioration such as discoloration of the front face (exterior face) of the frame 14, that is, to provide a high quality aesthetic appearance.

Figure 7:
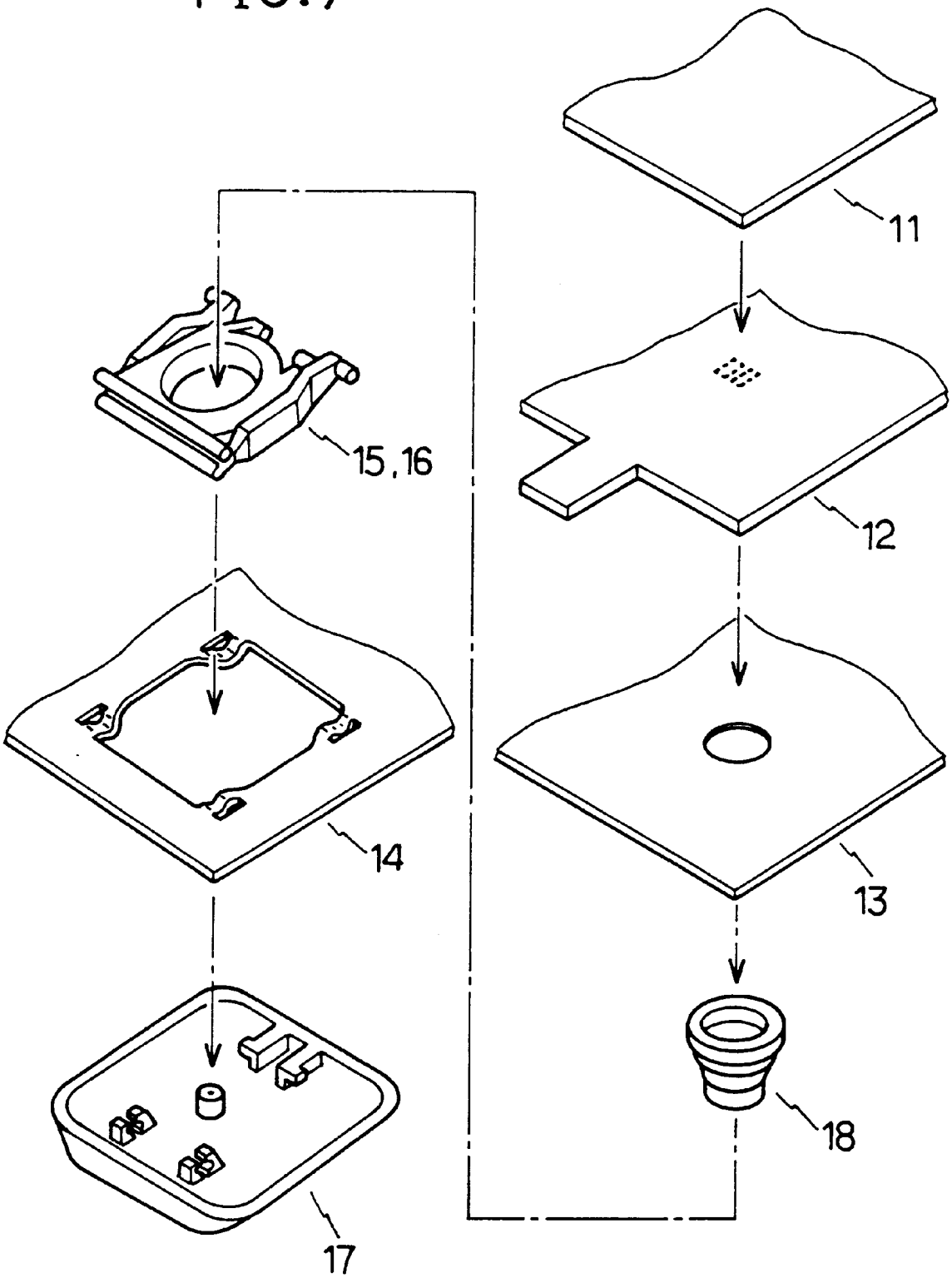
FIG. 7 is an exploded perspective view of the keyboard switch shown in FIG. 4.

FIG. 7 illustrates the various component parts of the keyboard switch shown in FIG. 4 in an exploded view in which the direction of the assembly sequence is shown by arrows. It will be seen from FIG. 7 that the illustrated keyboard switch may be assembled simply by building up the component parts one on another successively in one direction and that the assembly operation may be extremely easily carried out. Further, it is to be appreciated that if the rubber member 18 is adhesively mounted on the insulation sheet 13 in advance, the ease of assembly may be further improved.

While in the embodiment as described above the frame 14 and the plate 11 are considered as being assembled and secured together by laser welding, the assembly may be done by any other suitable method such as staking or caking, or slide fitting.

Figure 8A:
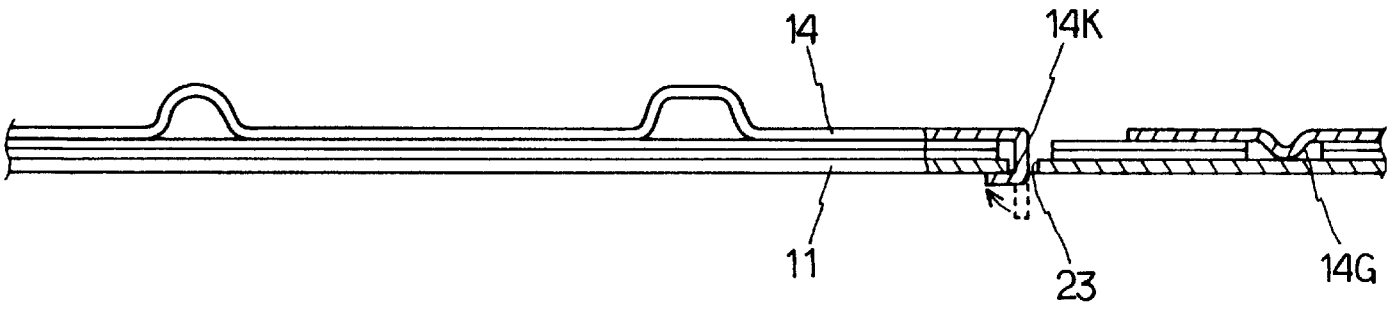
FIG. 8A is a view illustrating how to secure the frame and plate together.
Figure 8B:
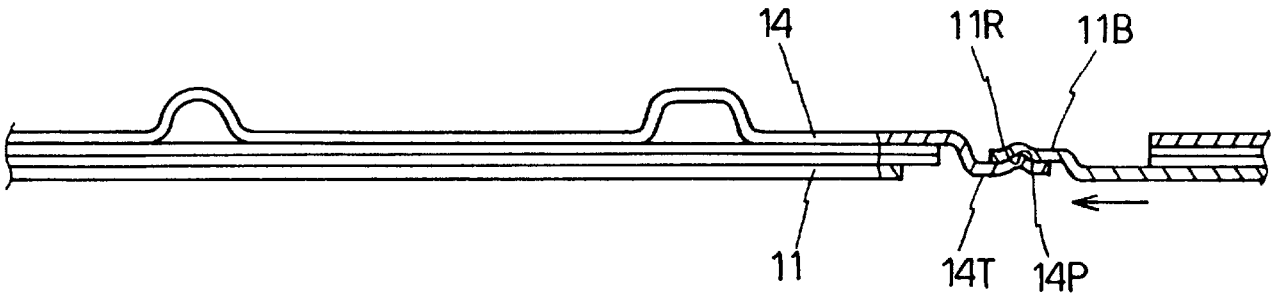
FIG. 8B is a view illustrating an alternate method of securing the frame and plate together.

FIGS. 8A and 8B schematically illustrate how to bond the frame and plate together. In the case of staking, a staking tab 14K may be formed by lancing perpendicularly out of the frame 14 as shown in FIG. 8A, and then it can be inserted through an aperture 11A formed in the plate 11, followed by crimping the outer end of the tab onto the plate 11. It should be noted, however, that according to such staking method the outer end of the staking tab 14K protrudes beyond the plane of the plate 11. Therefore, the welding method as illustrated in FIG. 4 which may produce no such protrusion is preferred to the staking method in respect of reducing the thickness.

In the case of slide fitting, mating joint tabs 11B and 14T may be formed in the plate 11 and the frame 14, respectively, as by a cutting and bending process as shown in FIG. 8B, and those joint tabs 11B and 14T may have concave dimple 11R and convex dimple 14P nestable into one another as shown. The assembly of the plate 11 and the frame 14 may be accomplished as by sliding the plate 11 in the direction indicated by the arrow in FIG. 8B until the mating joint tabs 11B and 14T are brought into fitting engagement. It will thus be appreciated that the engagement of the mating joint tabs 11B and 14T with each other functions to position and lock the plate 11 and the frame 14 in place.

It is also to be understood that as shown in FIG. 8A, a dowel 14G may be formed on the frame 14 so as to extend toward the plate 11 so that a predetermined spacing between the plate 11 and the frame 14 may be maintained by the dowel 14G.

Second embodiment

Figure 9:
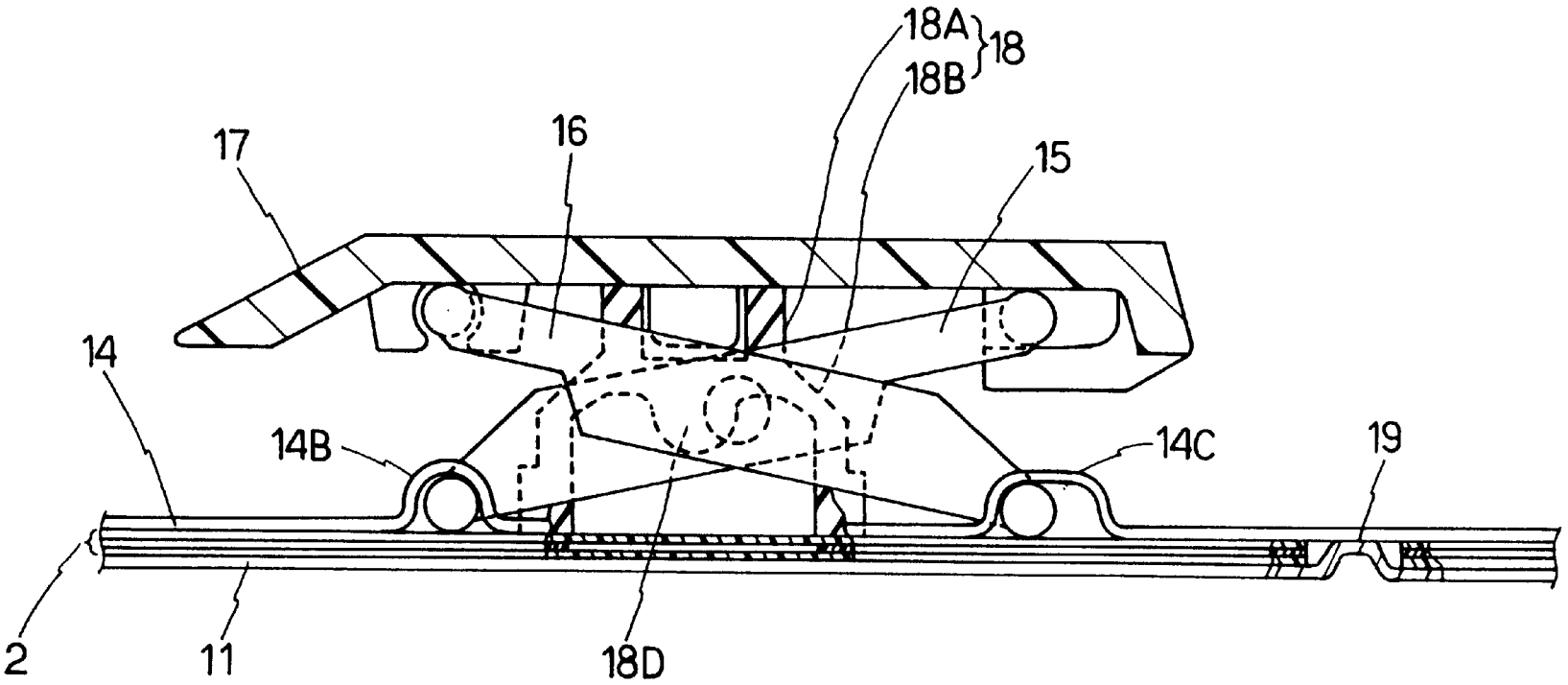
FIG. 9 is a cross-sectional view illustrating a second embodiment of this invention.

While the first embodiment shown in FIG. 4 illustrates the instance where the pattern sheet 12 is used, a membrane sheet 2 in lieu of the pattern sheet 12 may be employed on the plate 11 as in the second embodiment shown in FIG. 9. The membrane sheet 2 may be of construction similar to that described previously and shown in FIG. 2, but a metal frame 14 is disposed on the membrane sheet 2.

A dome-like rubber member 18 is disposed on the membrane sheet 2 over its contact region within an opening 14A in the frame 14, and in this example is provided with a push-button portion 18B. It is to be noted that the frame 14 and the plate 11 are bonded together at a weld joint 19 by laser welding. The construction is otherwise similar to that of the first embodiment shown in FIG. 4 and will not be further described.

This keyboard switch shown in FIG. 9 tends to be somewhat thicker than that shown in FIG. 4 in that it uses the membrane sheet 2, but still the use of the metal sheet frame 14 makes it possible to reduce the thickness of the entire keyboard switch as compared to the prior art.

Figure 3B:
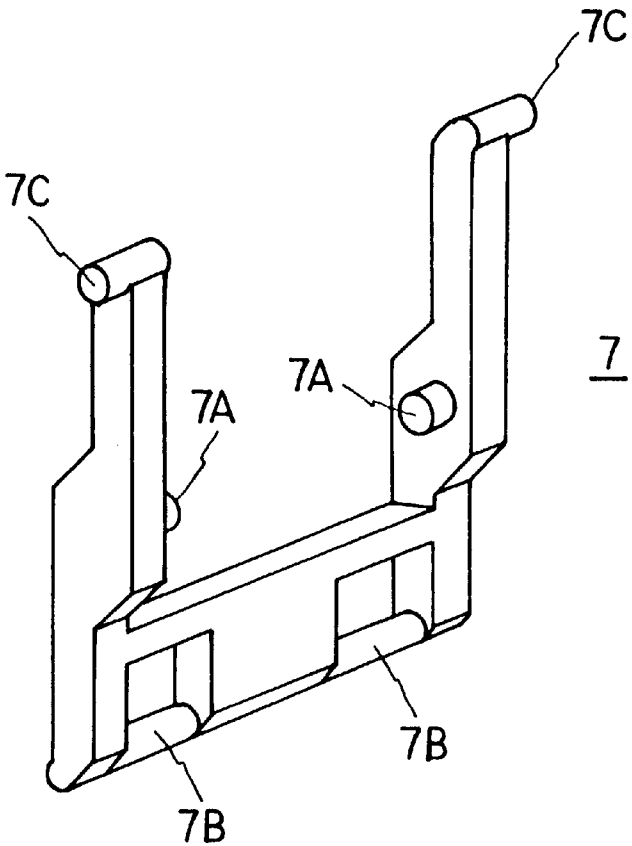
FIG.3B PRIOR ART
FIG. 3B is a perspective view of the link 7 shown in FIG. 1.
Figure 3A:
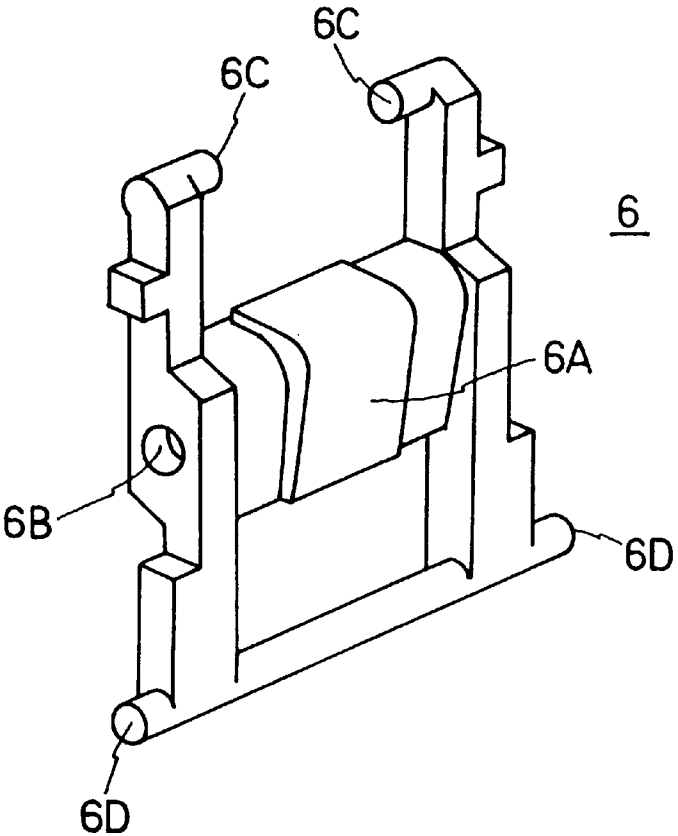
FIG.3A PRIOR ART
FIG. 3A is a perspective view of the link 6 shown in FIG. 1.

While in the keyboard switch shown in FIGS. 4 and 9 the rubber member 18 is interposed between the key top 17 and either the insulation sheet 13 or the membrane sheet 2 and is adapted to be pressed down directly by the key top 17 in either case, it is to be appreciated that one of the pair of links may have a pressure-applying portion 6A as with the link 6 in the conventional keyboard switch as described above with reference to FIGS. 3A and 3B such that the rubber member 18 may be pressed down by means of the pressure-applying portion.

As will be appreciated from the foregoing, the keyboard switch according to this invention illustrated as first and second embodiments in FIGS. 4 and 9, respectively may be configured to be low in profile and may be easily assembled simply by building up the component parts successively in one direction.

Third embodiment

As described above with reference to FIG. 7, the assembly of the links 15, 16 into the frame 14 is carried out by placing the assembled links 15 and 16 on the frame 14 from the bottom side thereof such that the shaft 15D and the stud shafts 16C are received in the bearings or catches 14B and 14C, respectively, followed by superposing the insulation sheet 13, the pattern sheet 12 and the plate 11 successively one after another and connecting and securing the frame 14 and the plate 11 as by laser welding. It is to be understood that the rubber member 18 may be preliminarily affixed to the insulation sheet 13 by adhesion.

It can be appreciated that such assembly may be performed by an automated process involving the steps of automatically transporting the parts being assembled successively to corresponding assembly stations. In this regard, it should be noted that if links 15, 16 are transported as simply placed on the frame 14, they can be dislocated from place on the frame 14 or even dislodged from the frame 14 in the worst case due to vibration and/or shock to which they may be subjected during the transportation. If such situation occurs, the links 15, 16 must be returned to their original positions. This problem is increasingly aggravated with reduction in size and weight of the links 15, 16, resulting in a significant lowering of efficiency of the assembly operation.

With this problem in mind, in the keyboard switch according to the first and second embodiments, the third embodiment is designed to prevent the shafts of the links from being inadvertently dislodged from the corresponding bearings or catches. According to the third embodiment, each of the links has a pair of pawls extending oppositely outwardly therefrom adjacent the bottom end thereof such that each of the pawls is located with respect to the corresponding bearing on the frame oppositely from the associated shaft of the link and projects slightly beyond the periphery of the opening of the frame over the panel portion surrounding the opening, whereby the pawls act to prevent the shafts of the links from being dislodged from the corresponding bearings or catches. The keyboard switch configured so as to prevent dislocation and dislodgement of the links will be described below with reference to FIGS. 10–13. The parts that correspond to those of FIGS. 4–9 are indicated by like reference numerals, and will not be discussed again.

Figure 10:
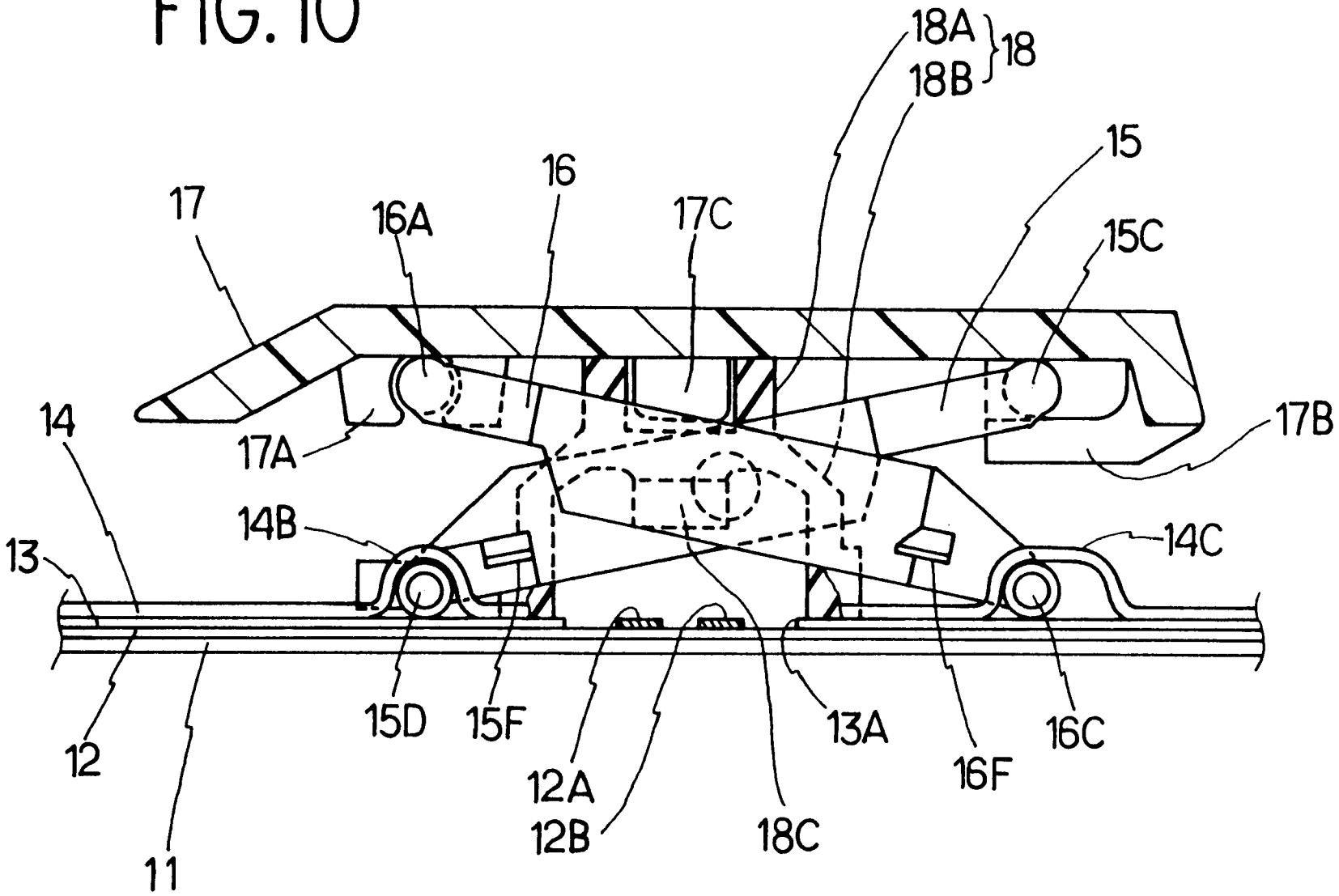
FIG. 10 is a cross-sectional view illustrating a third embodiment of this invention.
Figure 11A:
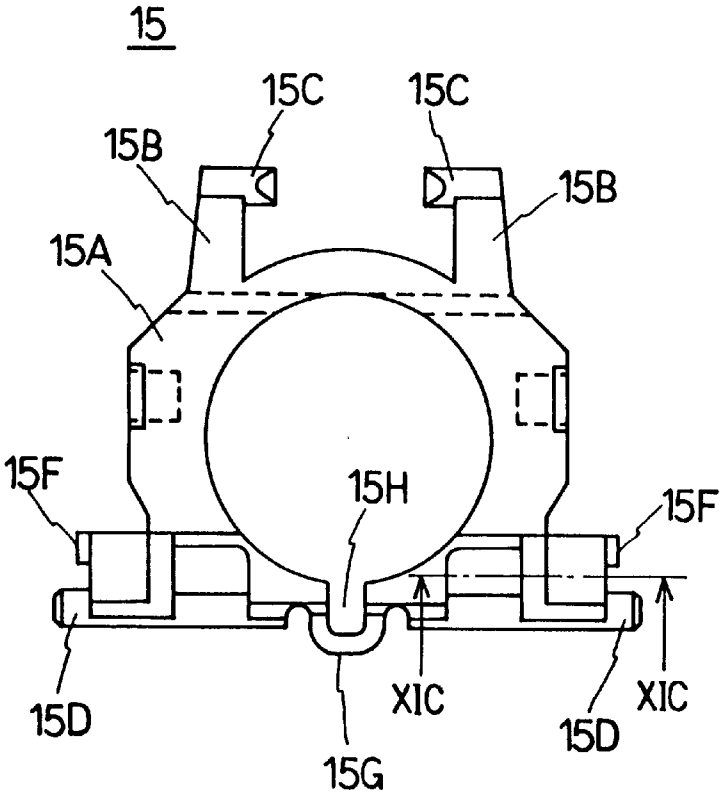
FIG. 11A is a plan view of the link 15 shown in FIG. 10.
Figure 11B:
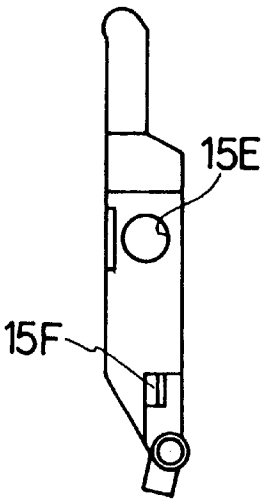
FIG. 11B is a side view of the link 15 shown in FIG. 10.
Figure 11C:
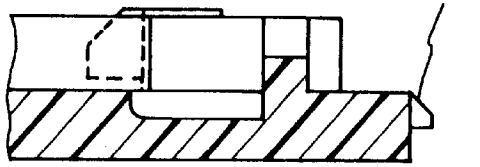
FIG. 11C is an enlarged cross-sectional view taken on line XIC—XIC in FIG. 1A.
Figure 12B:
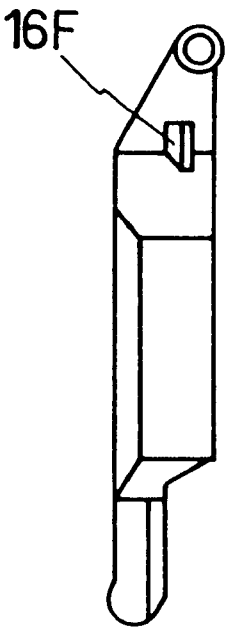
FIG. 12B is a side view of the link 16 shown in FIG. 10.
Figure 12A:
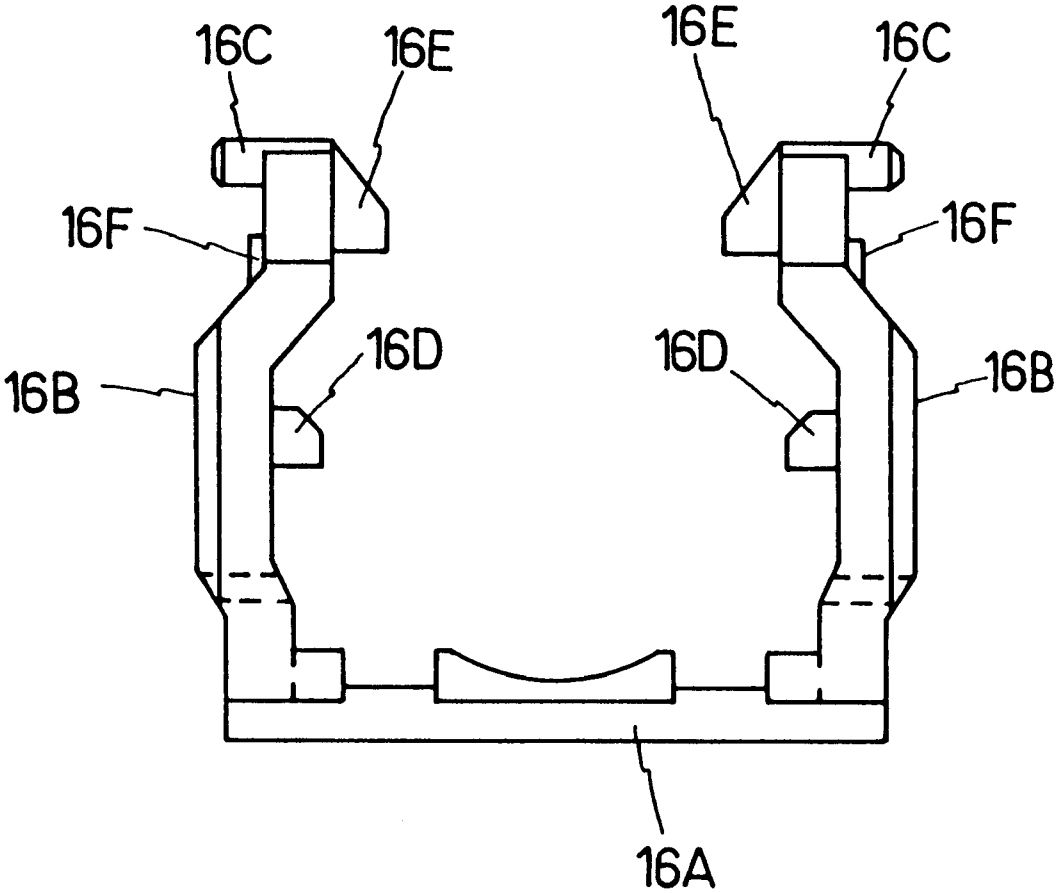
FIG. 12A is a plan view of the link 16 shown in FIG. 10.

In FIGS. 10, 11A, 11B, 11C, 12A and 12B, the links 15, 16 each have a pair of pawls 15F, 16F formed thereon adjacent the corresponding shafts 15D, shafts 16C thereof. FIGS. 11A, 11B and 11C are a plan view, a side view and a fragmentary cross-sectional view taken along the line XIC—XIC in FIG. 11A, respectively illustrating the link 15 formed with the pawls 15F. FIGS. 12A and 12B are a plan view and a side view, respectively illustrating the link 16 formed with the pawls 16F In the link 15, the pair of pawls 15F are formed to extend oppositely outwardly parallel to the shafts 15D at a location spaced slightly away from the shafts 15D towards the shafts 15C.

In the link 16 (FIGS. 12A and 12B), the pair of pawls 16F are formed to extend oppositely outwardly from the two legs 16B at a location spaced slightly away from the shafts 16C towards the shaft 16A. The links 15, 16 are molded plastic parts. In the illustrated example, as shown in FIG. 11A, 11B and 11C, the annular base 15A of the link 15 is formed with a notch 15H between a pair of shafts 15D and a U-shaped curved joint 15G circumventing the notch 15H so as to act as a leaf spring interconnecting the shafts.

Figure 13A:
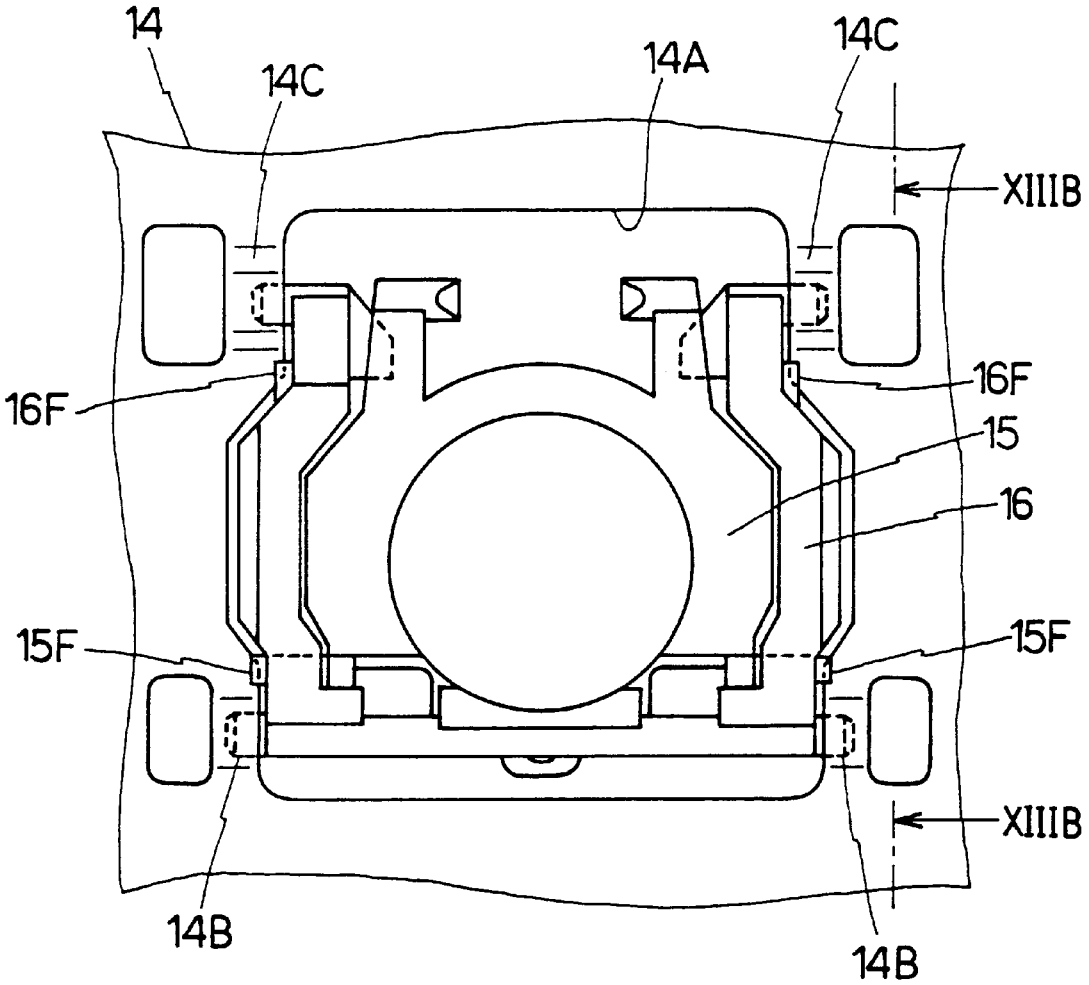
FIG. 13A is a view illustrating the links fitted in the frame.

The pawls 15F and 16F are formed to be located with respect to the corresponding bearings 14B, 14C on the frame 14 oppositely from the associated shafts 15D, 16C of the link as shown in FIG. 10, and the length of lateral projection of the pawls is sized such that they projects slightly beyond the periphery of the opening 14A of the frame 14 over the panel portion surrounding the opening as shown in a plan view in FIG. 13A.

The assembly of the links 15, 16 constructed as described just above into the frame 14 is carried out by placing the assembled links 15 and 16 on the frame 14 from the bottom side thereof as in the first embodiment. When this is done, the links 15, 16 need only slightly be pressed to fit the pawls 15F, 16F into and through the opening 14A of the frame 14. In this regard, each of the pawls 15F, 16F is provided with a taper at the insertion end to facilitate the insertion into the opening 14A.

Figure 13B:
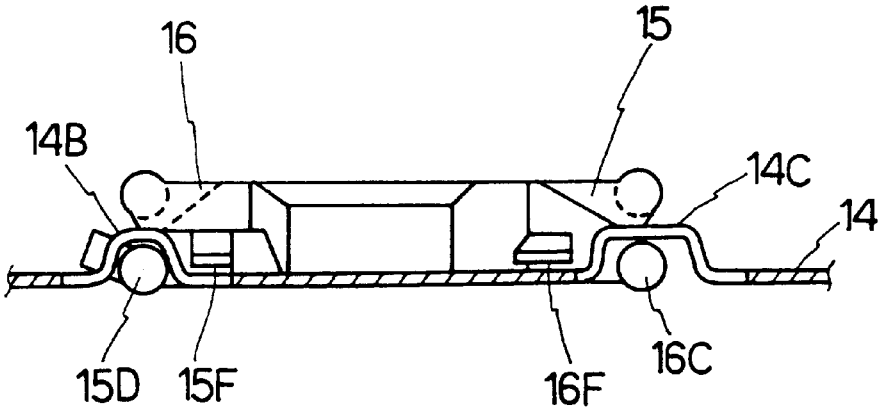
FIG. 13B is a cross-sectional view taken along the line XIIIB—XIIIB in FIG. 13A.

With the aforesaid pawls 15F and 16F provided on the links 15 and 16, respectively, the links 15 and 16 are so constructed that the bearings 14B and 14C of the frame 14 are held between the pawl 15F and the shaft 15D and between the pawl 16F and the shaft 16C, respectively as shown in FIG. 13B, whereby the shafts 15D and 16C are located in position by the bearings 14B and 14C, respectively of the frame 14 and are prevented by the pawls 15F and 16F from being dislodged from the associated bearings 14B and 14C, respectively.

It is thus to be appreciated that with this construction, dislocation and dislodgement of the links with respect to the frame 14 may be prevented even when the links are subjected to vibration and/or shock while being transported during the assembly process.

Figure 14A:
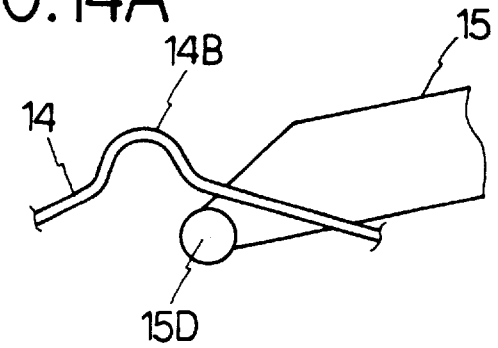
FIG. 14A is a sketch illustrating what the links would be when the frame was deformed in the absence of the pawls.
Figure 14B:
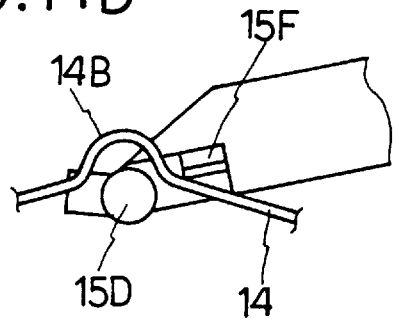
FIG. 14B is a sketch illustrating how the frame is deformed when the pawls are present.

When in the keyboard switch in its finished state the frame 14 is subjected to such deformation as to lift it off the underlying layer, for example, in the embodiment shown in FIG. 4, there is a possibility that the shaft 15D of the link 15 may be dislodged from the bearing 14B as illustrated with reference to the bearing 14B in FIG. 14A. In contrast, in the embodiment shown in FIG. 10 in which the link 15 is provided with the pawls 15F, the bearings 14B and 14C are partly held between the pawls 15F and the shafts the provision of the pawls 15F, 16F can avoid the problem that even when the frame 14 in the finished keyboard switch is deformed, the links 15, 16 may be dislodged from the frame 14.

As noted above, the shafts 15D, 16C of the links 15, 16 are assembled into the bearings 14B and 14C, respectively from the back side of the frame 14. On the contrary, however, if an attempt is made to assemble the shafts 15D, 16C of the links 15, 16 into the bearings 14B and 14C, respectively from the front side of the frame 14, it has heretofore been impossible particularly because the pair of stud shafts 15D of the link 15 is made in the form of a one-piece shaft as shown in FIG. 10A which cannot be fitted between a pair of catches 14B. Consequently, it has been impossible to replace the links 15 (16) when required.

As opposed to this, in this embodiment, the first link 15 is provided with the curved joint 15G functioning as a spring as noted above, and in addition that portion of the annular base portion 15A extending between the pair of legs 15B is thinner in the wall thickness than the rest of the base portion 15A so that it is permitted to elastically deform the pair of legs 15B toward each other. It is thus to be appreciated that during the assembly, the link 15 may be assembled into the frame 14 from the top side of the frame by grasping and squeezing the opposed sides of the annular base portion 15A to flex toward each other to thereby reduce the spacing between the outer ends of the two legs 15B. With regard to the second link 16, shafts 16C are provided on the free ends of the relatively long legs 16B so that the pair of legs 16B are permitted to be moved toward each other by virtue of elastic deformation. It will thus be appreciated that this embodiment provides for assembling the links 15, 16 into the frame from the top side thereof, which facilitates easy and convenient replacement and repair of the links 15, 16.

Figure 15:
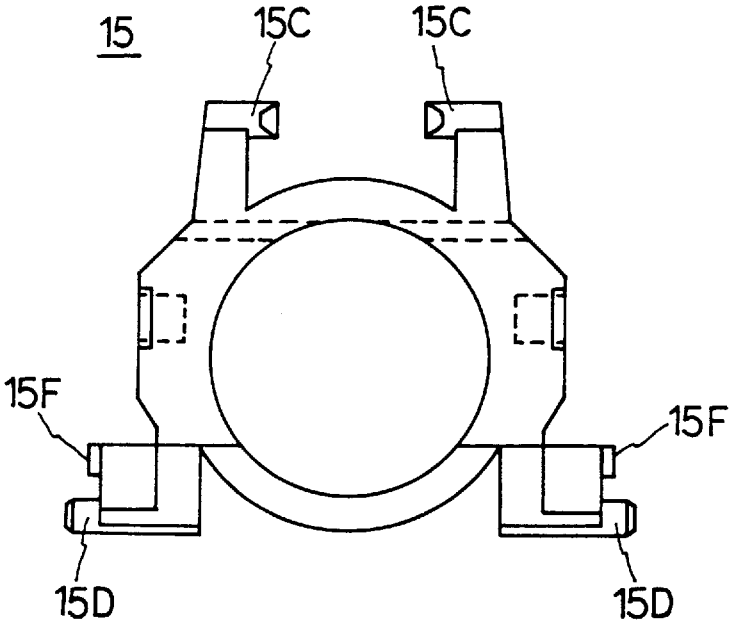
FIG. 15 is a plan view showing another form of the link 15.

The link 15 is not limited to the configuration illustrated in this embodiment, but may be of another configuration such as shown in FIG. 15 in which a pair of stud shafts 15D are capable of elastic deformation toward each other.

Figure 16:
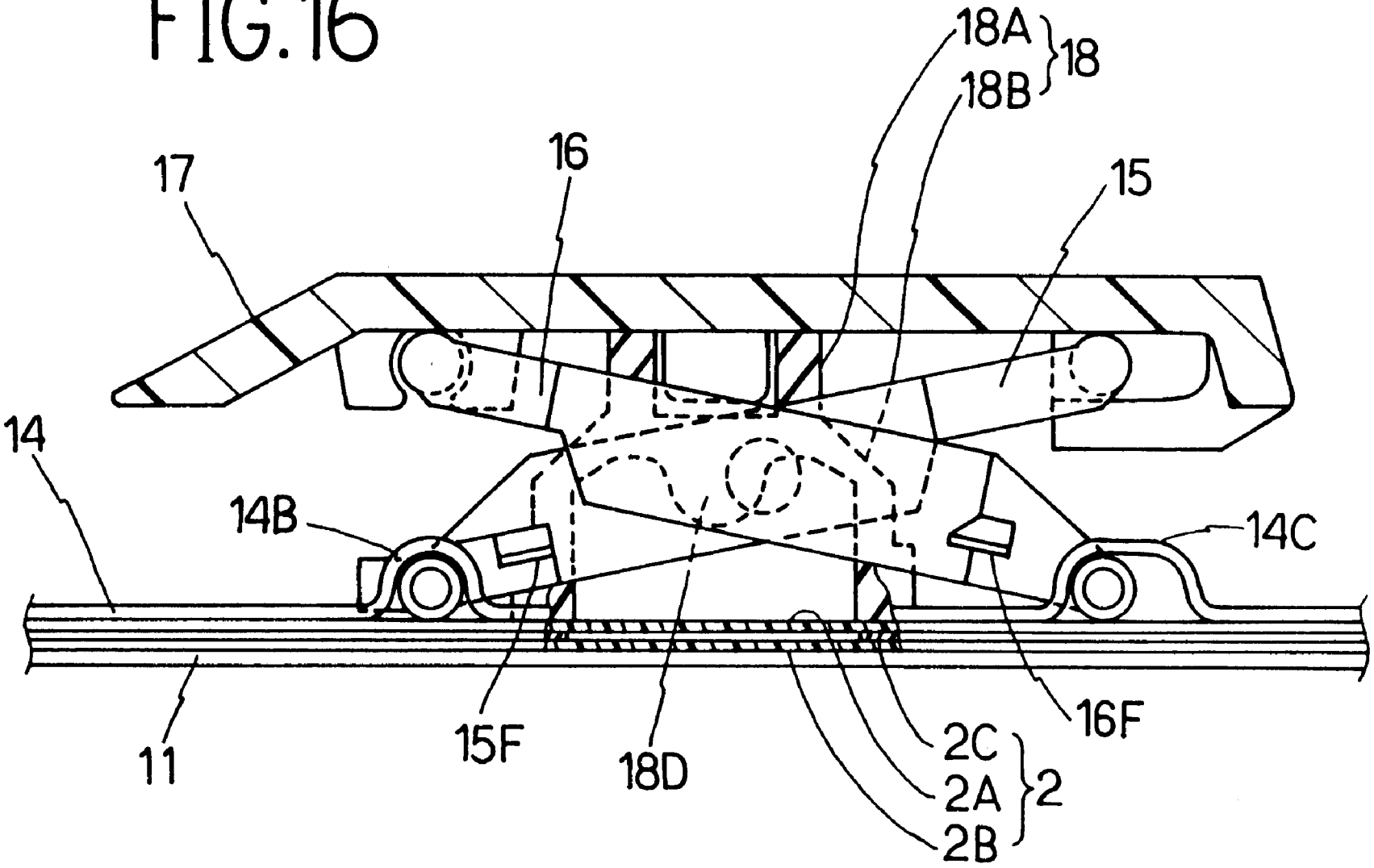
FIG. 16 is a cross-sectional view illustrating a fourth embodiment of this invention.

FIG. 16 illustrates a modified form of the embodiment as described with reference to FIGS. 10–15 in which a membrane sheet 19 is used in lieu of the pattern sheet 12 and the insulation sheet 13.

Figure 2:
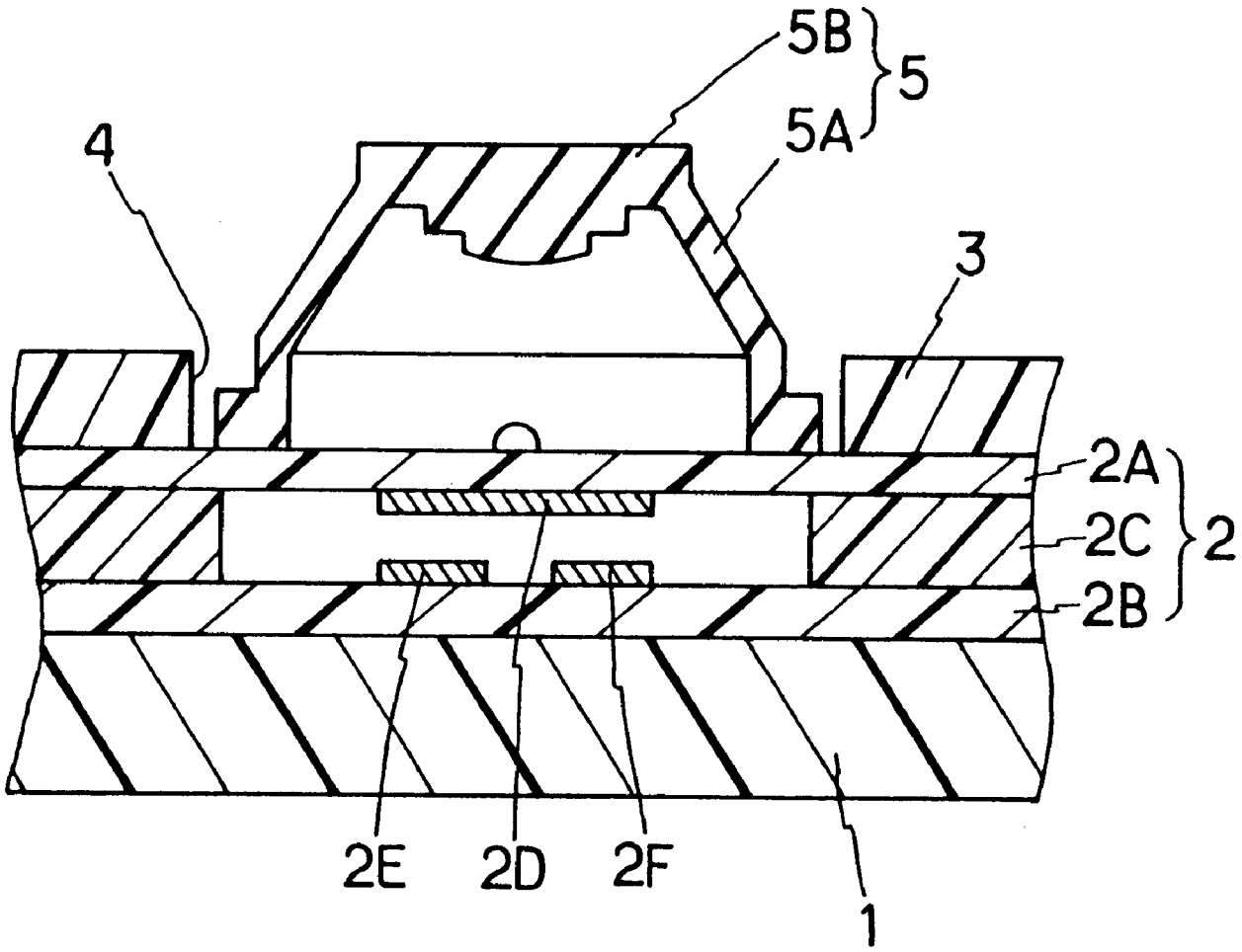
FIG.2 PRIOR ART
FIG. 2 is an illustration of the construction of the membrane sheet shown in FIG. 1.

The membrane sheet 19 comprises a pair of laminated contact layers 19B and 19C spaced apart by a spacer 19A, and contact patterns formed on the opposed surfaces of the contact layers, as described with reference to FIG. 2. These contact patterns are adapted to be brought into contact with each other upon being pressed. Disposed on the membrane sheet 19 is a frame 14 having an opening 14A within which a dome-like rubber member 18 is mounted on the membrane sheet 19. It is noted that in this example the rubber member 18 is configured to have a push-button portion 18D for pressing on the contact region of the membrane sheet 19.

As discussed above, it will be appreciated that the embodiment of FIG. provides for preventing the dislocation of the links 15, 16 with respect to the frame 14 and dislodgement of the links from the frame 14 to thereby greatly enhance the working efficiency in the assembly process. In addition, even when the frame 14 is subjected to deformation in the keyboard switch in its finished state, the problem may be prevented from occurring that the links 15, 16 may come off and dislodged from the frame 14. Moreover, the ability to assemble the links 15, 16 into the frame 14 from the top side thereof facilitates simplified replacement and repair of the links 15, 16 which has previously been impossible.

Fourth embodiment

Figure 17:
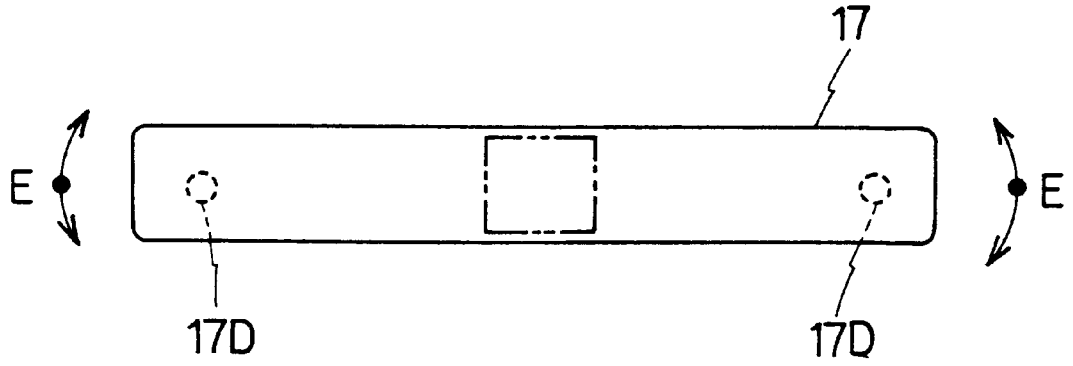
FIG.17 PRIOR ART
FIG. 17 is a top plan view illustrating an example of the conventional large elongated key.
Figure 18:
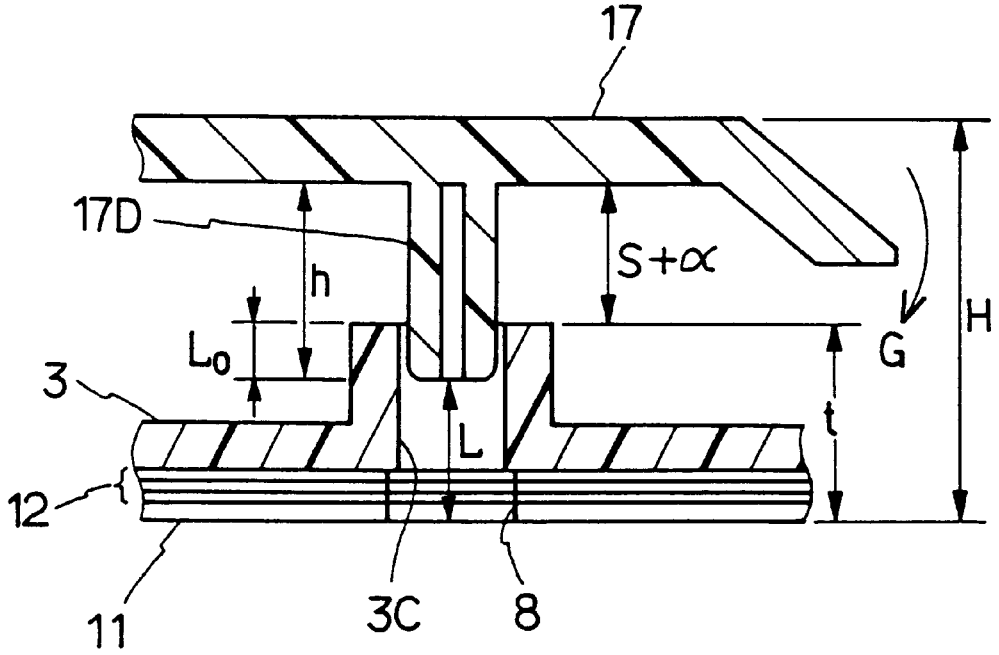
FIG.18 PRIOR ART
FIG. 18 is a vertical cross-sectional view of the conventional large elongated key shown in FIG. 17.

It should be noted here that the keyboard contains some keys such as space keys having an extremely high aspect ratio, that is, having a long side dimension extremely longer than the short side dimension. FIG. 17 is a top plan view illustrating a space key which is representative of the conventional large elongated keys. It is seen that the set of links 15, 16 in the various embodiments as described above is positioned in the central area of the key top 17 shown in two-dot-broken lines. In the conventional keyboard switch, the key top 17 has bosses 17D extending from its bottom side adjacent its longitudinally opposite ends to prevent rotation (play) of the key top 17 of such large elongated key in the direction E indicated by the arrows. As shown in FIG. 18 depicting the conventional keyboard switch in a cross-sectional view, these bosses 17D are adapted to be vertically slidably fitted in bearing portions 3C formed integrally with and extending upright from the housing 3 for sliding movement with vertical motions of the key top 17. It is noted that the membrane sheet 2 and the plate 1 have apertures 8 extending therethrough in vertical alignment with the corresponding bearing portions 3C.

As indicated above, in the prior art, the key top 17 is positioned at its opposite ends and prevented from rotation by engagement between the bosses 17D formed on the key top 17 and the bearing portions 3C formed on the housing 3. Consequently, it is required to maintain the engagement between the bosses 17D and the bearing portions 3C even when the key top 17 is in its initial state (top dead center).

It is assumed here as shown in FIG. 18 that the length of the initial engagement is Lo, the stroke of the keyboard switch is S, its margin (clearance) is $\alpha$, the spacing between the outer end of the boss 17D and the bottom surface of the plate 1 in the initial state is L, the length of the boss 17D is h, the distance between the top of the bearing 3C and the bottom surface of the plate 1 is t, and the height or vertical profile of the keyboard is H.

The requirement that the boss 17D should not be dislodged from the bearing 3C is $h<S+\alpha$. In the case of $h>t$, however, if the height (vertical profile) H of the keyboard is reduced, it is apparent from the drawing that the condition $L<S+\alpha$ will occur and that upon the key top 17 being completely depressed, the boss 17D will protrude beyond the bottom surface of the plate 1. Such condition is aggravated proportionally as the profile H of the keyboard is reduced. It is thus to be understood that the anti-rotation mechanism utilizing such bosses 17D is unsuitable for use with a low-profile keyboard switch. In other words, such mechanism is a factor for imposing a limit to reducing the thickness of the keyboard switch. Besides, in key operation, when the key top 17 is pressed down on one end thereof (adjacent the boss 17D, for instance), the key top 17 tends to be rolled in the direction indicated by the arrow G as the one end of the key top 17 is deeply sunk while the other end is only slightly depressed.

In view of this problem, the invention provides another embodiment of the keyboard switch having large elongated keys which are capable of preventing rotation (play) of the key tops and yet allow for lowering the profile of the keyboard switch. In such embodiment, the large elongated key includes a key top supported for vertical movement on a frame by means of a pair of links comprising a pantograph mechanism, and guide means having parallel shafts provided on its opposite ends, the shafts on one end of the guide means being rotatably supported in journal bearings provided on the frame and the shafts on the other end of the guide means being slidably held in slide bearings provided on the bottom side of the key top, the guide means being configured to be restrained in the aforesaid displacement in the axial direction of the shafts by the journal bearings and the slide bearings.

This embodiment will be described below with reference to the drawings. The parts that correspond to those of FIG. 4 are indicated by like reference numerals, and will not be discussed again.

Figure 19A:
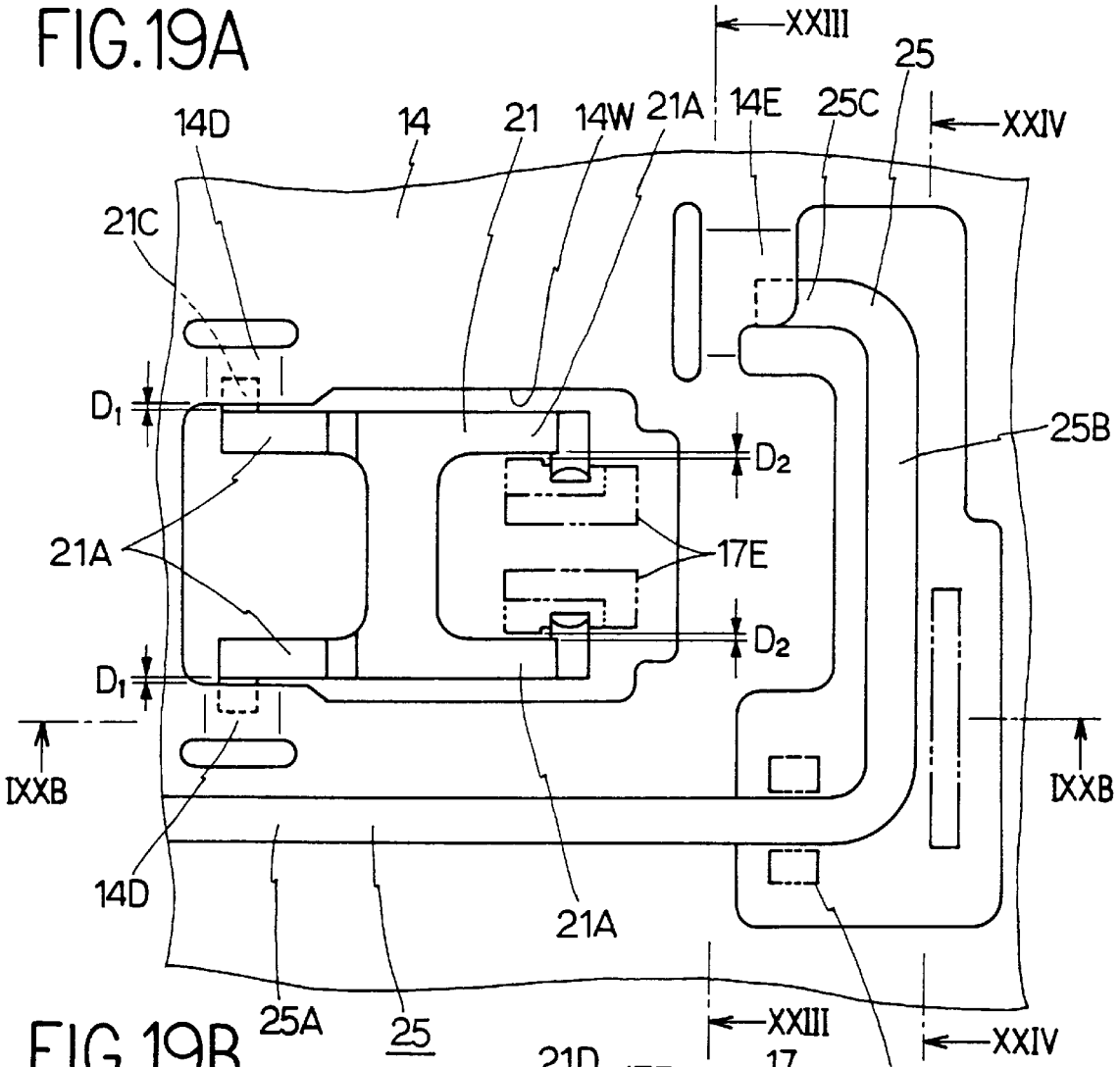
FIG. 19A is a plan view illustrating a fifth embodiment of this invention.
Figure 19B:
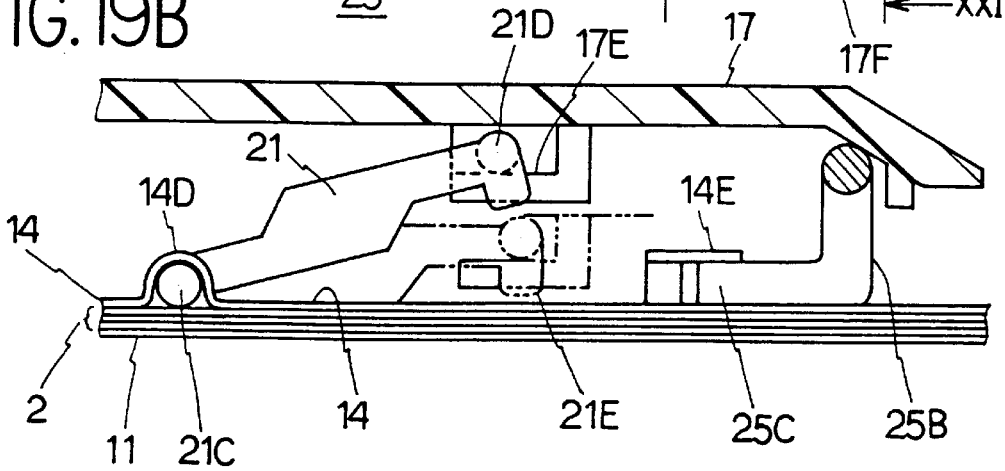
FIG. 19B is a cross-sectional view of FIG. 19A.

FIGS. 19A, 19B illustrate an example of the large elongated key as the keyboard switch according to this embodiment. FIG. 19A illustrates one of guides 21 disposed on a metal frame 14 below the key top 17 adjacent the opposite ends of the large elongated key, and an interlocking rod 25 extending from adjacent the one end of the large elongated key top to adjacent the other end thereof. FIG. 19B shows a cross section including the key top 17 taken along the line IXXB—IXXB in FIG. 19A. In this embodiment, the guide 21 is interposed between the key top 17 and the frame 14 at the longitudinal end of the key top 17. The length of the guide 21 is aligned with that of the key top 17.

Figure 20A:
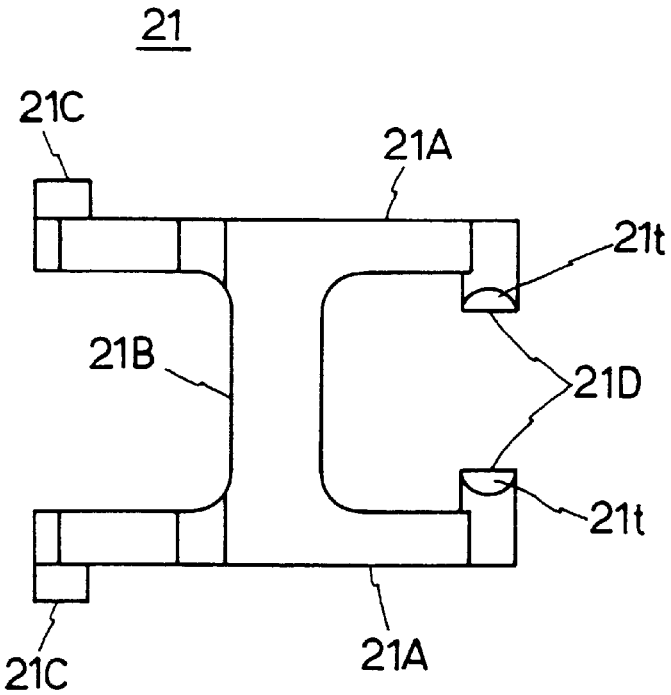
FIG. 20A is a plan view of the guide shown in FIGS. 19A and 19B.
Figure 20B:
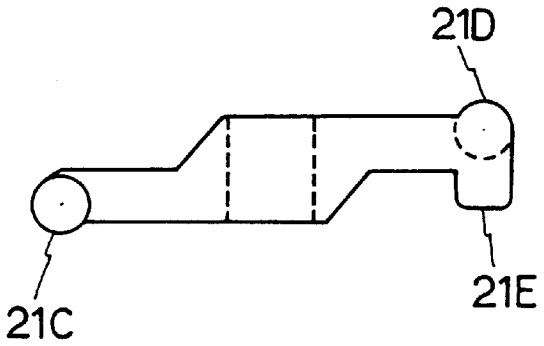
FIG. 20B is a front view of the guide.
Figure 20C:
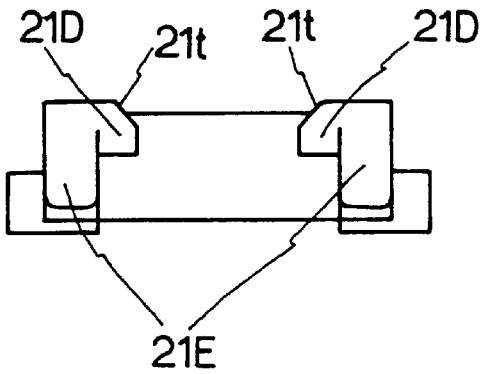
FIG. 20C is a side view of the guide.

As shown in FIGS. 20A, 20B, 20C, each of the guides 21 is generally in the shape of H comprising a pair of substantially parallel legs 21A and a connecting bar 21B interconnecting the legs intermediate their opposite ends. The two legs 21A have stud shafts 21C extending outwardly oppositely therefrom adjacent first ends thereof and another pair of stud shafts 21D extending therefrom adjacent the other ends thereof inwardly toward each other and parallel to the shafts 21C. The legs 21A further have projections 21E extending therefrom adjacent the other ends thereof at right angles to the axes of both the legs 21A and the shafts 21D as shown.

As shown in FIGS. 19A, 19B, the shafts 21C are rotatably supported in journal bearings 14C formed on the frame 14 while the shafts 21D having tapered surfaces 21*t* are slidably held in slide bearings 17E provided on the bottom side of the key top 17. It is thus to be understood that the guide 21 is rotated (pivoted) about the axis of the shafts 21C with vertical movement of the key top 17. In this regard it is to be noted that the generally semi-circular journal bearings 14C of the frame 14 may be formed by a drawing process and are closed by the membrane sheet 2 to embrace the shafts 21C.

Figure 21A:
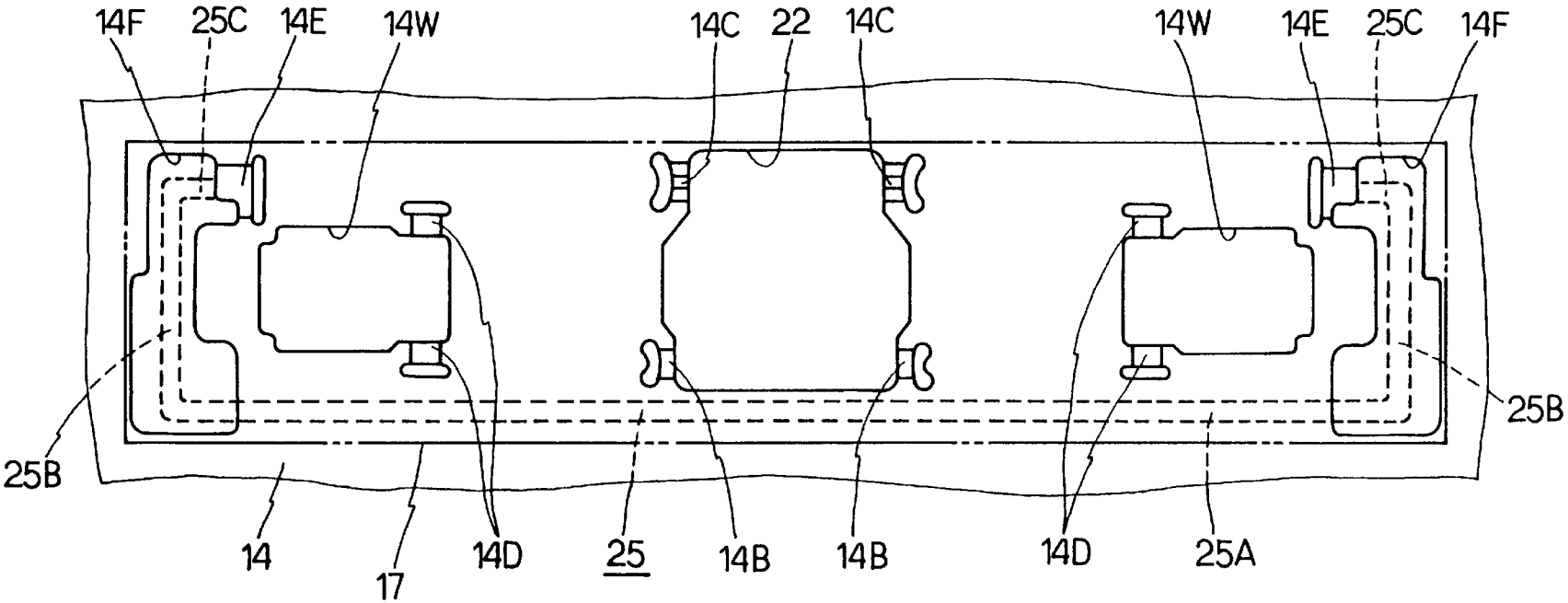
FIG. 21A is a plan view of the frame shown in FIGS. 19A and 19B.
Figure 21B:
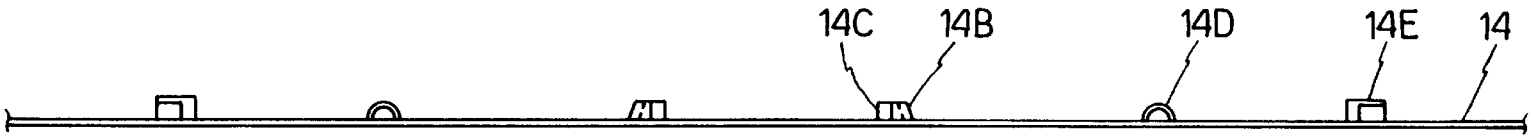
FIG. 21B is a front view of the frame.

FIGS. 21A, 21B illustrate the configuration of the portions of the metal sheet made frame 14 in FIGS. 19A and 19B opposing the key top 17 the outer contour of which is shown in two-dot-broken lines.

Formed through the frame 14 in opposition to the middle portion of the key top 17 is a central opening 14A around the periphery of which a pair of journal bearings 14B for receiving the shafts 15D of the link 15 and a pair of slide bearings 14C for receiving the shafts 16C of the link 16 are formed by a drawing process as are the journal bearings 14D.

On the other hand, a pair of journal bearings 14D for the associated guide 21 arranged at right angles to the length of the key top 17 are formed on both marginal sides of each of openings 14W formed in the frame on longitudinally opposite sides of the central opening 14A. In this example, one guide 21 is disposed at each of both opposite ends of the key top 17. It is to be noted that the slide bearings 14E formed adjacent the peripheries of openings 14F formed longitudinally outwardly of the respective openings 14W are used to receive the interlocking rod 25 (see FIGS. 19A, 19B).

As shown in FIG. 19A, the guide 21 is positioned over the associated opening 14W in the frame 14, and the clearances D1 between the lateral edges of the journal bearings 14D and the outer side surfaces of the legs 21A are kept to a minimum, so that the guide 21 is restrained in the displacement in the axial direction of the shafts 21C by the two journal bearings 14D.

Likewise, the clearances D2 between the lateral edges of the slide bearings 17E and the inner side surfaces of the legs 21A are kept to a minimum, so that the guide 21 is restricted in the displacement in the axial direction of the shafts 21D by the two slide bearings 17E. It is thus to be appreciated that the thus constructed guides 21 serve to substantially eliminate rattling movements of the key top 17 relative to the frame 14 as they prevent the rotation of the key top 17 in the direction E (see FIG. 17).

Figure 22:
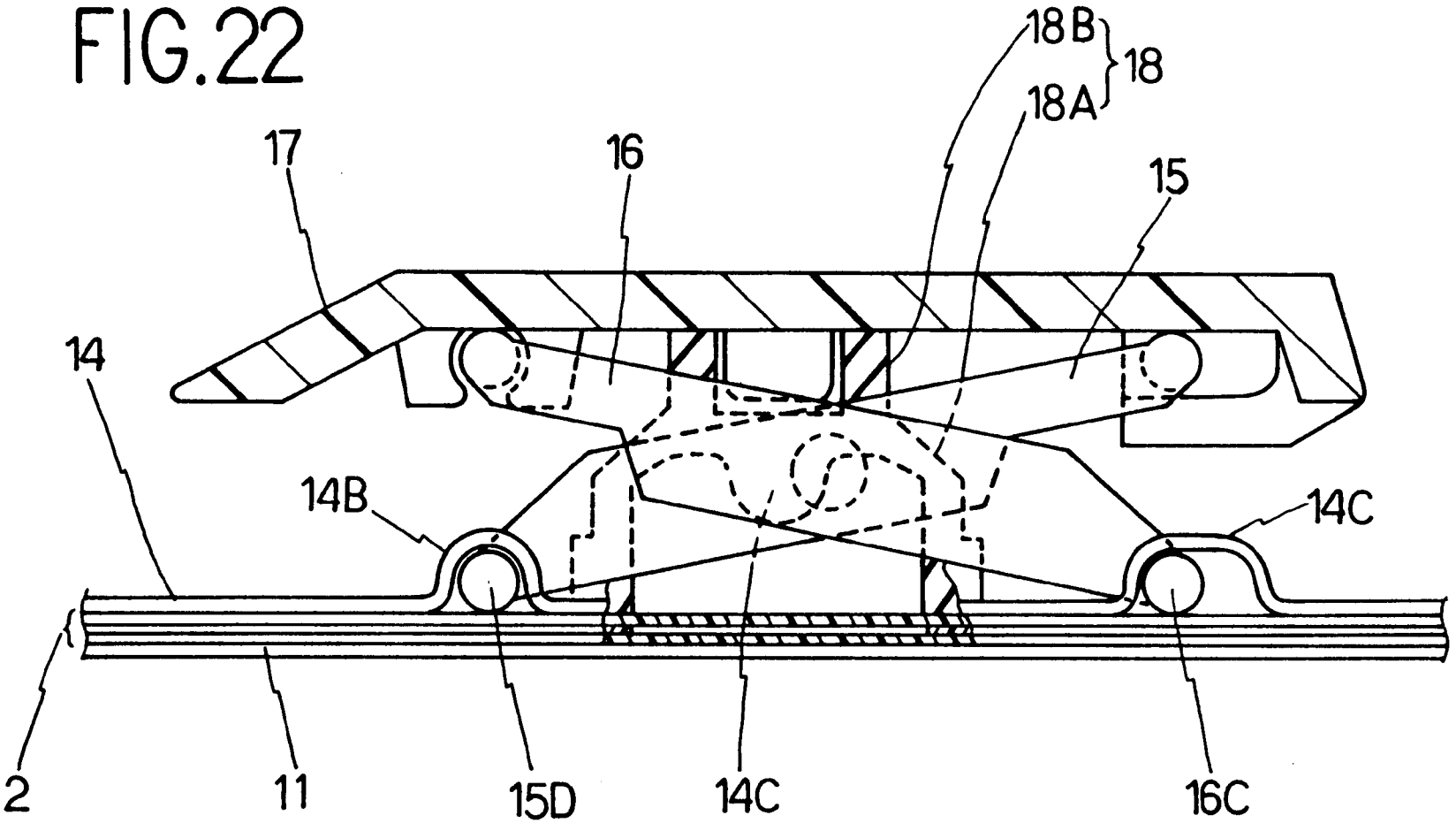
FIG. 22 is a cross-sectional view showing the construction of the key taken vertically along the center of the key top.

FIG. 22 shows the construction in cross-section of the key taken vertically along the center of the key top 17 where the links 15, 16 are mounted. The shafts 15D and the shafts 16C are embraced in the generally semi-circular journal bearings 14B and the generally trapezoidal slide bearings 14C formed on the frame by a drawing process. The length of the links 15, 16 extend at right angles to the length of the key top 17. These configurations are the same as those described with respect to the first embodiment.

Figure 23:
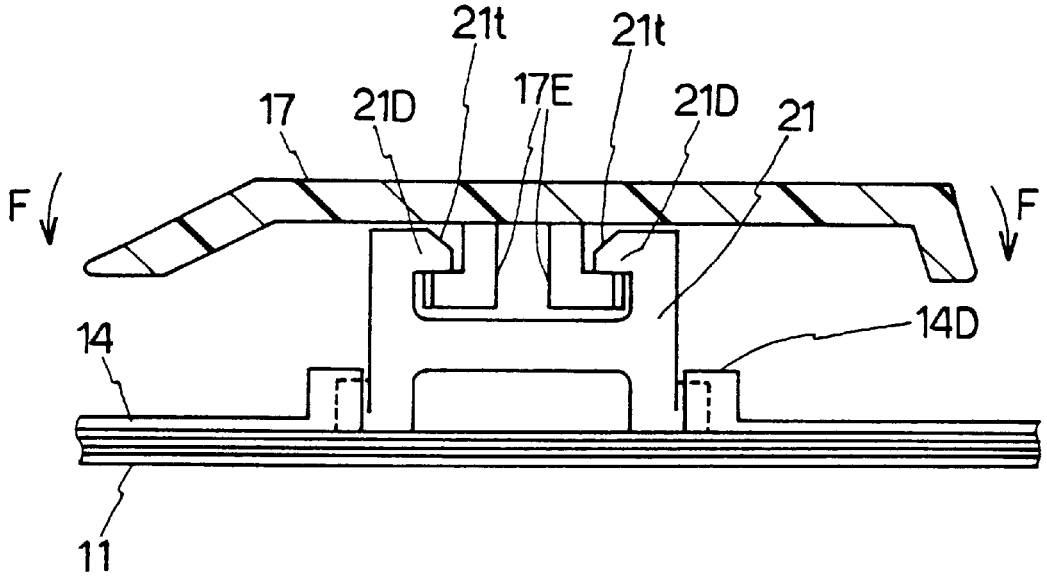
FIG. 23 is a sketch showing how the guide functions to prevent tilting of the key top.

FIG. 23 shows the construction associated with the guide 21 including the large elongated key top 17 in a cross-sectional view taken along the line XXIII—XXIII in FIG. 19A in the same direction as the cross-sectional view of FIG. 22 is taken. The pair of shafts 21D of the guide 21 are simultaneously depressed as the key top 17 is pressed down. That is, ganged (interlocking) control is provided in which as one of the shafts 21D is lowered the other shaft 21D is concurrently lowered, whereby the tilt of the key top 17 due to rolling in the direction F indicated by the arrows is also suppressed by the guide 21.

Figure 24:
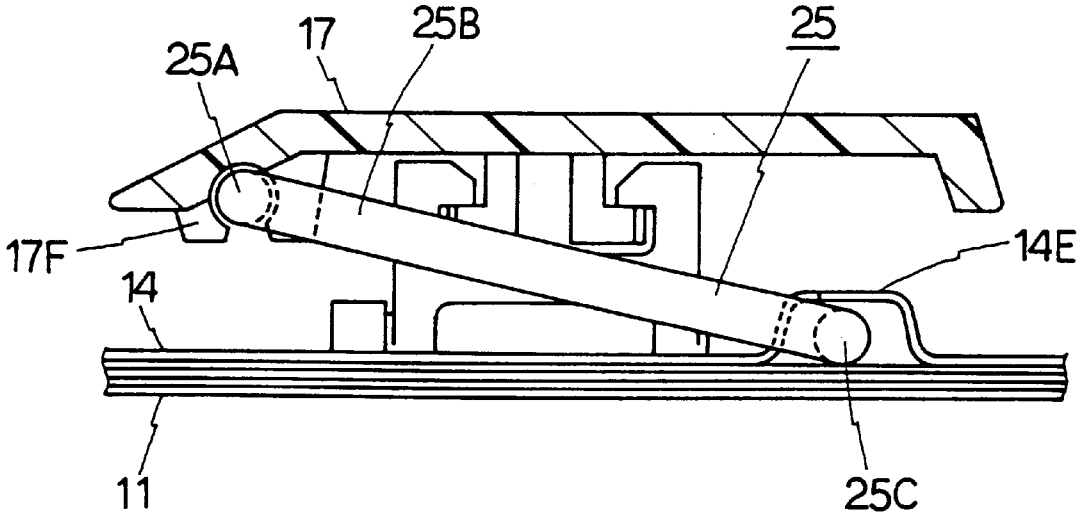
FIG. 24 is a sketch showing how the interlocking rod performs its retaining function.

FIG. 24 shows the construction for retaining the interlocking rod 25 in a cross-sectional view taken along the line XXIV—XXIV in FIG. 19A. The interlocking rod 25 comprises an intermediate section 25A extending between the longitudinal opposite ends of the key top 17 as shown in dotted lines in FIG. 21A, short interlocking arms 25B extending at right angles from the opposite ends of the intermediate section, and interlocking slide shafts 25C extending inwardly toward each other at right angles from the respective arms 25B. The intermediate section 25A of the interlocking rod 25 is rotatably supported in journal bearings 17F formed on the bottom side of the key top 17 adjacent one longitudinal side edge thereof while the interlocking slide shafts 25C are slidably supported in the generally trapezoidal slide bearings 14E formed on the frame 14. It is thus to be appreciated that as one end of the key top 17 is pressed down, the resulting pivotal movement of the associated interlocking arm 25B is translated to the other interlocking arm 25B at the opposite end, whereby the rotation as shown at G in FIG. 18 may be minimized.

Figure 25A:
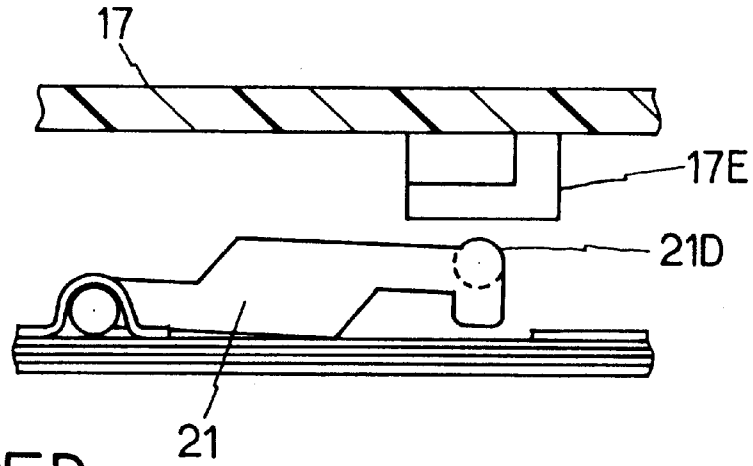
FIG. 25A is a sketch showing the state as the key top is depressed for press-fitting.
Figure 25B:
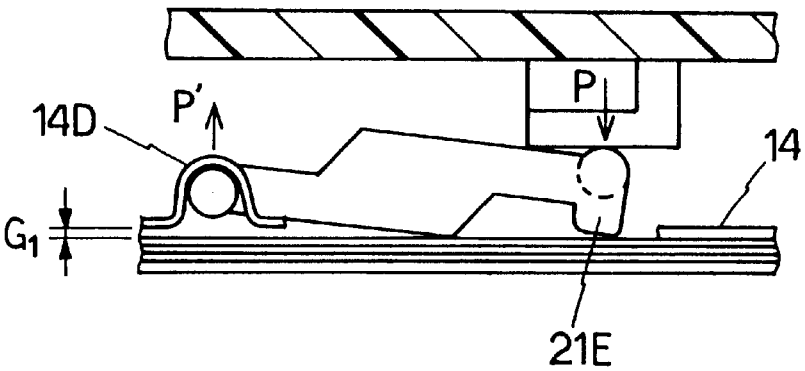
FIG. 25B is a sketch showing how the frame is deformed.
Figure 25C:
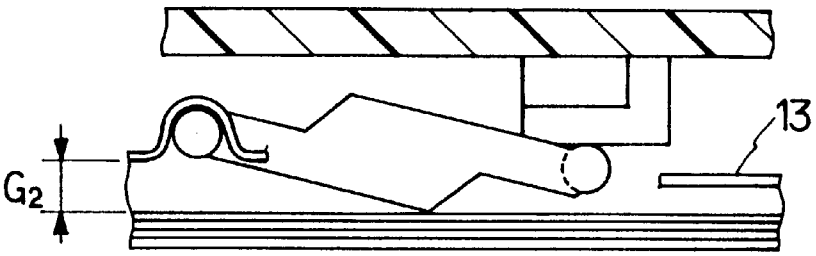
FIG. 25C is a view similar to FIG. 25B, but showing the case in which the guide is provided with no protrusion.

Fitting of the stud shafts 21D of the guide 21 into the slide bearings 17E of the key top 17 may be accomplished by resiliently flexing the two legs 21A adjacent the shafts 21D outwardly away from each other as the slide bearings 17E are forced between the shafts 21D through the tapered surfaces 21*t* (see FIG. 23) of the shafts. This process is shown in FIGS. 25A, 25B. The force P applied to the shafts 21D as the key top 17 is press fitted will produce a leverage force P' acting on the journal bearings 14D of the frame which in turn causes some deformation (lift-off $G_1$) on the frame 14. However, the arrangement is such that the projections 21E protruding toward the frame 14 act to limit the lowering of the shafts 21D to thereby suppress the deformation of the frame 14. FIG. 25C illustrates the instance in which the guide is not provided with the projections 21E. It is seen that a noticeable lift-off $G_2$ or deformation will be caused.

The extent of protrusion of the projections 21E is such that upon the key top 17 being completely pressed down, the lower ends of the projections 21E do not come into touch with the frame 14. The lowermost position of the key top 17 is shown in two-dot-broken lines in FIG. 19B in which it is seen that the lower end of the projection 21E is slightly spaced apart from the upper surface of the frame 14.

While in the various embodiments as described above a pair of guides 21 are shown as being disposed one on each of the longitudinal opposite ends of the large elongated key top 17, it will be apparent to those skilled in the art that only one guide 21 may be provided depending upon the size (length) of the key top 17. In that case, the interlocking rod 25 and the associated journal and slide bearings 17F, 14E.

Effects of the Invention

As will be appreciated from the foregoing description, in lieu of the conventional plastic made housing this invention employs a frame formed of metal sheet the thickness of which may be drastically reduced as compared to the plastic housing, thereby realizing a corresponding reduction in thickness of the entire keyboard switch.

In addition, the frame, being made of metal, exhibits a superior dimensional stability as well as a good heat sinking property whereby an enhancement in the performance may also be aimed at.

For the large elongated key, guide means for restricting movements of the key top in any other directions than intended is provided between the key top and the frame at a location spaced from the aforesaid pair of links, and further an interlocking rod may be provided as required to minimize undesirable rotation (rattling movements) of the key top, and yet there is anti-rotation means (bosses) protruding from the bottom surface of the plate as was the case with the prior art. It is thus to be appreciated that the present invention realizes a remarkable reduction in the vertical profile of the keyboard switch.

What is claimed is:

1. A keyboard switch comprising:

switch sheet means having contact pattern means formed thereon, said contact pattern means constituting switch means;

a frame formed of metal sheet disposed on one side surface of said switch sheet means, said frame having an opening formed therethrough in an area covering said contact pattern means;

a pair of first bearing means and a pair of second bearing means formed integrally with said frame by a drawing process, said pairs of first and second bearing means arranged so as to surround said opening and adjacent the periphery of said opening;

a first link and a second link pivotally connected together intermediate their opposite ends to form a pantograph mechanism and movably engaged at their first ends with said pairs of first and second bearing means, respectively;

a key top having third and fourth bearing means provided on its bottom surface, the second ends of said first and second links being movably engaged with the corresponding third and fourth bearing means so that said key top is supported by said first and second links for movement parallel to the plane of said frame;

dome-like switch actuating means formed of rubber disposed within said opening in said frame in opposition to said contact pattern means and adapted to be elastically deformed by downward pressing of the key top to establish electrically conductive continuity through said contact pattern means and to allow the key top to return to its original position when the key top is released; and a plate formed of sheet metal disposed on the other side surface of said switch sheet means so as to sandwich the switch sheet means between the plate and said frame.

2. The keyboard switch of claim 1 wherein said switch sheet means comprises a pattern sheet having said contact pattern means formed thereon and an insulation sheet disposed on said pattern sheet and formed with an aperture to expose said contact pattern means, said dome-like switch actuating means having a conductor portion therein adapted to be brought into contact with said contact pattern means to establish electric continuity therethrough upon said key top being pressed down.

3. The keyboard switch of claim 1 wherein said switch sheet means is a membrane switch sheet comprising a first insulation sheet on which said contact pattern means is formed, a second insulation sheet on which a conductor portion is formed, and an electric insulation spacer having a cell aperture defining a space surrounding said contact pattern means and said conductor portion and sandwiched between said first and second insulation sheets, and said dome-like switch actuating means being disposed on said second insulation sheet and operative upon said key top being pressed down to elastically deform the second insulation sheet within the region of said cell aperture to bring said conductor portion into contact with said contact pattern means.

4. The keyboard switch of claim 1, 2 or 3 wherein said switch sheet means has an aperture extending therethrough within which said plate and frame are welded and secured together.

5. The keyboard switch of claim 1, 2 or 3 wherein said pair of first bearing means comprise a pair of journal bearings rotatably supporting the first end of said first link, said pair of second bearing means comprising a pair of slide bearings slidably supporting the first end of said second link.

6. The keyboard switch of claim 5 wherein said third bearing means on the bottom surface of said key top comprising a pair of third journal bearings rotatably engaging the second end of said second link, said fourth bearing means comprising a pair of fourth slide bearings slidably engaging the second end of said first link.

7. The keyboard switch of claim 6 wherein said first link comprises an annular base portion having a through bore larger than the diameter of said dome-like actuating means, a pair of parallel legs extending from one semi-circular segment of the annular base portion adjacent opposite ends thereof, a pair of first slide shafts extending oppositely at right angles from outer ends of said pair of legs and slidably supported in said pair of fourth slide bearings, and a pair of first pivotal shafts extending parallel to said first slide shafts and oppositely from each other from the periphery of another semi-circular segment of said annular base portion opposite from said legs and rotatably supported in said pair of first bearings;

said second link comprising a pair of arms extending parallel to each other and joined together to form generally a U-shape, a pair of second pivotal shafts extending oppositely outwardly from the joint portion of the U-shape and rotatably supported in said pair of third bearings on said key top, and a pair of second slide shafts extending oppositely in linear alignment at right angles from said pair of arms adjacent their outer ends and slidably supported in said pair of second bearings; and side surfaces of said annular base portion opposed in the diametrical direction parallel to said pair of first pivotal shafts being rotatably supported between said pair of arms of said second link.

8. The keyboard switch of claim 1, 2 or 3 wherein said first link includes a pair of pivotal shafts extending oppositely outwardly from one end thereof and rotatably supported in said pair of first bearing means;

said second link including a pair of slide shafts extending oppositely outwardly from one end thereof and slidably supported in said pair of second bearing means; and said first and second links each having a pair of pawls extending oppositely outwardly therefrom adjacent said pair of first bearings and said pair of second bearings, respectively on the side of said first and second bearings opposite from said pivotal shafts and said slide shafts.

9. The keyboard switch of claim 8 wherein said pair of pivotal shafts are elastically deformable toward each other as are said pair of slide shafts.

10. The keyboard switch of claim 9 wherein said first link comprises an annular base portion having a through bore larger than the diameter of said dome-like actuating means, a pair of first pivotal shafts extending oppositely outwardly in parallel and spaced relation to each other from one semi-circular segment of said annular base portion and rotatably supported in said pair of first bearings, a pair of legs extending in parallel and spaced relation to each other from the other semi-circular segment of said annular base portion, a pair of first slide shafts extending oppositely outwardly at right angles from the outer ends of said two legs and slidably supported in said pair of fourth bearings on said key top said annular base portion being cut between said pair of first pivotal shafts to form a gap and having a thinned curved portion formed integrally therewith, said curved portion circumventing said gap and interconnecting opposed cut ends of said annular base portion so that said annular base portion is elastically deformable between said pair of first pivotal shafts to vary the distance therebetween;

said second link comprising a pair of elastically deformable arms extending parallel to each other and joined together at first ends to form a generally U-shaped configuration, a pair of second pivotal shafts extending oppositely outwardly from the joint portion between said pair of arms and rotatably supported in said third bearings on said key top, and a pair of second slide shafts extending oppositely outwardly in linear alignment at right angles from said pair of arms adjacent their outer ends and slidably supported in said pair of second bearings; and the side surfaces of said annular base portion opposed in the diametrical direction parallel to said pair of first pivotal shafts being rotatably supported between said pair of arms of said second link.

11. The keyboard switch of claim 1, 2 or 3 wherein said key top is a key top for use with a large elongated key having a long side extending at a right angle to the length of said first and second links, and further including a guide means disposed between said key top and said frame adjacent one end of said key top, said guide means comprising:

a pair of guide slide bearings spaced in a direction perpendicular to the long side of said key top and integrally formed with the key top on the bottom surface thereof adjacent said one end of the key top;

a pair of guide journal bearings spaced in a direction perpendicular to the long side of said key top and formed on said frame by a drawing process under said key top adjacent said one end thereof; and a guide including a pair of generally parallel guide arms connected together intermediate their opposite ends, a pair of first guide shafts provided on first ends of said guide arms and rotatably supported in said pair of guide journal bearings, and a pair of second guide shafts provided on the second ends of said guide arms and slidably supported in said pair of guide slide bearings on the bottom surface of said key top;

said guide being restricted in displacement in a direction axial of said first and second guide shafts by said guide journal bearings and guide slide bearings.

12. The keyboard switch of claim 11 wherein said guide arms have projections adjacent said first end protruding toward said frame, said projections being sized such that the outer ends of said projections will be slightly spaced from said frame when said key top is in its pressed down position.

13. The keyboard switch of claim 11 wherein another guide means similar to said guide means is disposed between said key top and said frame adjacent the other end of said key top.

14. The keyboard switch of claim 13, further including an interlocking means disposed between said key top and said frame, said interlocking means comprising a pair of interlocking journal bearings formed on said key top adjacent one long side thereof, a pair of interlocking slide bearings formed on said key top by a drawing process adjacent an other long side thereof at the opposite ends thereof, an intermediate rod section extending between the opposite ends of the key top and rotatably engaged with said pair of interlocking journal bearings, a pair of interlocking arms extending parallel to each other at right angles from the opposite ends of the intermediate rod section, and a pair of interlocking slide shafts extending oppositely from the outer ends of the interlocking arms and slidably engaged with the pair of interlocking slide bearings.

* * * * *